US009900956B2

(12) United States Patent
Huang et al.

(10) Patent No.: US 9,900,956 B2
(45) **Date of Patent: *Feb. 20, 2018**

(54) MULTI-FUNCTION LIGHTING SYSTEM

(71) Applicant: INDUSTRIAL TECHNOLOGY RESEARCH INSTITUTE, Hsinchu (TW)

(72) Inventors: Sheng-Ho Huang, Kaohsiung (TW); Chia-Fen Hsieh, Zhubei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/979,925

(22) Filed: Dec. 28, 2015

(65) Prior Publication Data

US 2016/0113090 A1 Apr. 21, 2016

Related U.S. Application Data

(63) Continuation-in-part of application No. 14/485,886, filed on Sep. 15, 2014, now Pat. No. 9,578,709, which
(Continued)

(30) Foreign Application Priority Data

Jan. 31, 2011 (TW) ..... 100103720 A

(51) Int. Cl.
*H05B 37/02* (2006.01)
*H05B 33/08* (2006.01)

(52) U.S. Cl.
CPC ..... *H05B 33/0872* (2013.01); *H05B 33/0854* (2013.01); *H05B 33/0866* (2013.01);
(Continued)

(58) Field of Classification Search
CPC ..... H05B 37/02; H05B 33/0854; H05B 33/0866; H05B 33/0872; H05B 37/0227; H05B 37/0245; H05B 37/029
(Continued)

(56) References Cited

U.S. PATENT DOCUMENTS 6,156,743 A 12/2000 Whitcomb
6,236,622 B1 5/2001 Blackman
(Continued)

FOREIGN PATENT DOCUMENTS

TW 200952034 12/2009
TW I323767 4/2010
TW M381999 6/2010

OTHER PUBLICATIONS

TW Office Action dated Dec. 27, 2013.
(Continued)

*Primary Examiner* — Tung X Le
(74) *Attorney, Agent, or Firm* — McClure, Qualey & Rodack, LLP

(57) ABSTRACT

A multi-function lighting system is provided. Multiplex configuration of a lighting module and optical time domain modulation of an electric controlling system are applied to a lighting system which senses environmental conditions to automatically or artificially change a color, a light intensity and a color-temperature of a light to influence people's feelings and moods. The environmental sensing device further feedbacks an information of humidity or temperature so that parameter of optimum light environment can be set accordingly. The lighting module is applied to the design of the lighting system, such that the lighting system can be manufactured in a customization way to meet varied requirements in the landscaping and optical designs, not only reducing the cost and increasing mass production rate but also providing multi-functions including landscaping light-
(Continued)

ing, ergonomic lighting, display lighting, light communication, plant lighting air purifying, and preservation of fruits and vegetables.

38 Claims, 20 Drawing Sheets

Related U.S. Application Data is a continuation of application No. 13/237,775, filed on Sep. 20, 2011, now Pat. No. 8,847,508.

(52) U.S. Cl.
CPC ..... *H05B 37/029* (2013.01); *H05B 37/0227* (2013.01); *H05B 37/0245* (2013.01)

(58) Field of Classification Search
USPC ..... 315/149–159, 291, 292, 294, 297, 307, 315/308, 309, 312, 360
See application file for complete search history.

(56) References Cited

U.S. PATENT DOCUMENTS

| | | | | |
|---|---|---|---|---|
| 6,902,296 | B2 | 6/2005 | Searfoss, III | |
| 7,320,532 | B2 | 1/2008 | Searfoss, III | |
| 7,520,607 | B2 | 4/2009 | Casper et al. | |
| 7,722,212 | B2 | 5/2010 | Searfoss | |
| 8,253,681 | B2 | 8/2012 | Hayashi et al. | |
| 8,427,419 | B2 | 4/2013 | Ahn et al. | |
| 2005/0158687 | A1* | 7/2005 | Dahm | A61C 19/004 433/29 |
| 2005/0174473 | A1* | 8/2005 | Morgan | F21S 48/325 348/370 |
| 2006/0076908 | A1 | 4/2006 | Morgan et al. | |
| 2007/0258240 | A1 | 11/2007 | Ducharme et al. | |
| 2008/0265799 | A1 | 10/2008 | Sibert | |
| 2009/0201679 | A1* | 8/2009 | Konaka | F21K 9/68 362/235 |
| 2009/0281604 | A1 | 11/2009 | De Boer et al. | |
| 2010/0076250 | A1 | 3/2010 | Van Woudenberg et al. | |
| 2010/0328336 | A1* | 12/2010 | Si | G09G 3/3666 345/589 |
| 2011/0062888 | A1 | 3/2011 | Bondy et al. | |

OTHER PUBLICATIONS

Rea, M.S.; "Toward a Model of Visual Performance: Foundations and Data;" Journal of the Illuminating Engineering Society; Summer 1986; pp. 41-142.

"A Study on the Influence of Various Types and Spectral Characteristics of Artificial Lighting for Human Responses;" pp. 1-176; Jul. 9, 1997.

"A Study on the Influence of Illuminance and Color Temperature of Artificial Lighting on Visual Perception and Survey of Lighting Models-Using Living Room as an Example;" pp. 1-256.

* cited by examiner

MULTI-FUNCTION LIGHTING SYSTEM

This is a Continuation-In-Part of U.S. application Ser. No. 14/485,886, filed Sep. 15, 2014, which is a Continuation of U.S. application Ser. No. 13/237,775, filed Sep. 20, 2011, which claims the benefit of Taiwan application Serial No. 100103720, filed Jan. 31, 2011, the subject matters of which are incorporated herein by reference.

TECHNICAL FIELD

The disclosure relates in general to a multi-function lighting system, and more particularly to a lighting system with the functions of landscaping lighting, ergonomic lighting, display lighting, light communication, plant lighting, air purifying, and preservation of fruits and vegetables.

BACKGROUND

In recent years, people's requirements of living environment are getting higher and higher, and it is popular that people match the light colors with the decorative or artistic shapes of the lighting lamps, so that the surrounding space emanates certain atmospheres and moods, user's stylistic features can manifested, and environmental aesthetics is enhanced. Eventually, the living space further satisfies user's needs both physiological and psychological, and provides the user with enjoyable aesthetics and balance between the body and the mind.

Modern landscaping and space design places particular focus in the study of ergonomic engineering, environmental psychology, and aesthetic psychology with an aim to resolving people's requirements of their living environment in the aspects of physiological characteristics, behavior psychology and visual experience through scientific methods. The matching between light environment and colors is an important element in the design of landscaping and living environment, which affect people's physical and mental state by modulating the spectrum of the lighting lamp, and light parameters such as light intensity and color temperature. To harmonize the color of the space with the atmosphere through plants is a common practice in environmental design.

Research literatures show that through the use of illumination light, an environment with different scenarios which give people different feelings can be created. For example, as the spectrum energy of orange waveband (595 nm to 620 nm) increases, people will feel more comfortable, relaxed and spirited. Under the illumination environment with the color temperature being equal to 6500 K, as the spectrum energy of the blue waveband (435 nm to 490 nm) increases, people's internal organs related to respiratory and circulatory system, urinary system and biliary tract system will be significantly affected. High color temperature and high illumination (such as 6500 K and 450 lux) makes people feel excited. Low color temperature and middle illumination (such as 3200 K and 300 lux) makes people calm and peaceful. High color temperature and low illumination (such as 6500 K and 150 lux) makes people feel upset and depressed. Low color temperature and high illumination (such as 3200 K and 450 lux) feel unpleasant. In short, various combinations of illumination and color temperature affect people's moods and make them generate corresponding behaviors.

For example, red color helps to stimulate and excite people's nerve system, increase the secretion of epinephrine and enhance blood circulation. Green color has sedative effect, benefits those who are hyperactive or suppressed either physiological or psychological and helps the body to achieve balance and relieve dizziness, fatigue or negative emotion. Blue color environment provides a feeling of serenity and grace, and helps people to achieve internal balance. Blue color when used in a bedroom helps to relieve people of nervousness, headache, fever, dizziness, and insomnia. Yellow color stimulates people's nerve system and digestive system and enhances logic thinking. Orange color generates vitality, stimulates people's appetite and helps to maintain health, and is ideal for the places such as rumpus and kitchen.

In addition, light therapy has been widely used to improve the sleep and emotions of the sick or the seniors. Based on the response of the eyes when receiving the light, the light with special wavelengths and different light intensity levels is used for adjusting the timing at which melatonin is secreted by the pineal gland, so as to regulate people's biological clock to achieve a balanced rhythm and improve people's body temperature, sleep/wake cycle and action/rest rhythm.

A study of the environmental influence of plants on the indoor pathogen content and indoor humidity shows that when a substance volatilized from the leaves is mixed with the water vapor, the substances will suppress the growth of the pathogens in the air. Plants with high transpiration rate and large total foliar surface area help to increase indoor humidity and the dust in the air, so that the indoor air is effectively purified and the indoor air light quality is improved. Some plants help to absorb chemical substances that are hazardous to human body. The disposition of indoor foliage plants helps to alleviate people of the symptoms of infection in the nose, throat, and respiratory system. Also, research literatures show that people's anxiety and nervousness can be alleviated when household landscaping includes natural view or indoor plants. In comparison to the urban landscaping, sports or other entertainments, viewing landscaping plants or natural environment does better in alleviating people's fatigue or restoring people's concentration. In addition, a workplace with green landscaping not only benefits people's physiology and psychology but also helps to reduce people's pressure and anxiety and further increases people's morale and efficiency in their work. A hospital ward with green plants is beneficial to patients' recovery, and at the same time help to reduce patients' feeling of pain, negative emotions and hospital stay.

The disposition of plants in an indoor space is indeed beneficial to people's health both physiologically and psychologically. However, plants lacking sunlight cannot conduct photosynthesis, and will wither soon or end up with poor growth. Research literatures show that, suitable amount of light intensity of red light (610 nm to 720 nm) or blue light (400 nm to 520 nm) or a combination thereof is conducive to the growth of the plants.

SUMMARY

The disclosure is directed to a multi-function lighting system. The lighting source automatically or artificially changes the color, the light intensity and the color-temperature of the light to create varied light environments that influence people's feelings and moods. At the same time, the environmental sensing device further feedbacks the information of humidity or temperature so that parameter of optimum light environment can be set accordingly. Thus, the lighting module can provide multi-functions of landscaping lighting, ergonomic lighting, display lighting, light communication, plant lighting, air purifying, and preservation of fruits and vegetables.

According to an embodiment of the present disclosure, a multi-function lighting system is provided. The lighting system comprises at least a lighting module and an electric controlling system. The lighting module control unit modulates the light quality (such as photochromic matching), the light intensity and the color temperature of the light generated by the lighting module, so that the lighting module generates at least two light source states corresponding to at least two scenarios.

The above and other aspects of the disclosure will become better understood with regard to the following detailed description of the non-limiting embodiment(s). The following description is made with reference to the accompanying drawings.

DETAILED DESCRIPTION

The disclosure is related to a multi-function light emitting diode (LED) lighting system. The lighting system of the disclosure which provides multi-functions in one single lighting module is applicable to the conventional LED packaging process. Furthermore, the whole module can be manufactured by the substrate integrated process (such as the integrated circuit process), the light quality, the light intensity and the color temperature of the light can be modulated, the modulation of the light can be realized by time domain implementation, the manufacturing process/assembly can be modulized, and the light source module can be disposed in a customization way to meet design requirements. However, the embodiments disclosed below are for exemplification purpose only, not for limiting the scope of the disclosure.

Figure 1:
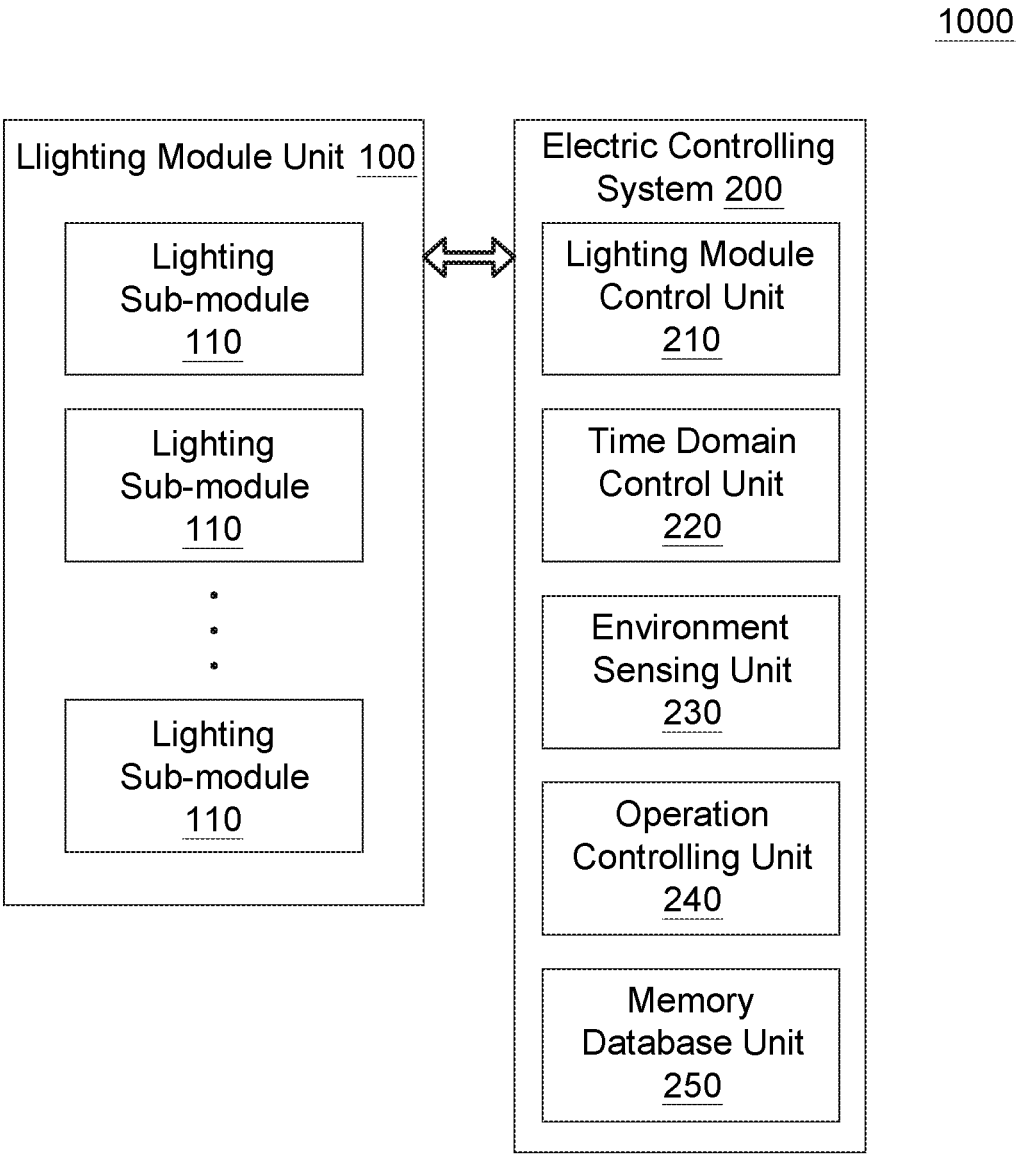
FIG. 1 shows a block diagram of a multi-function lighting system according to an embodiment of the disclosure.

Referring to FIG. 1, a block diagram of a multi-function lighting system 1000 according to an embodiment of the disclosure is shown. The multi-function lighting system 1000 of the present embodiment of the disclosure comprises one or more than one lighting module 100 and an electric controlling system 200.

Figure 2:
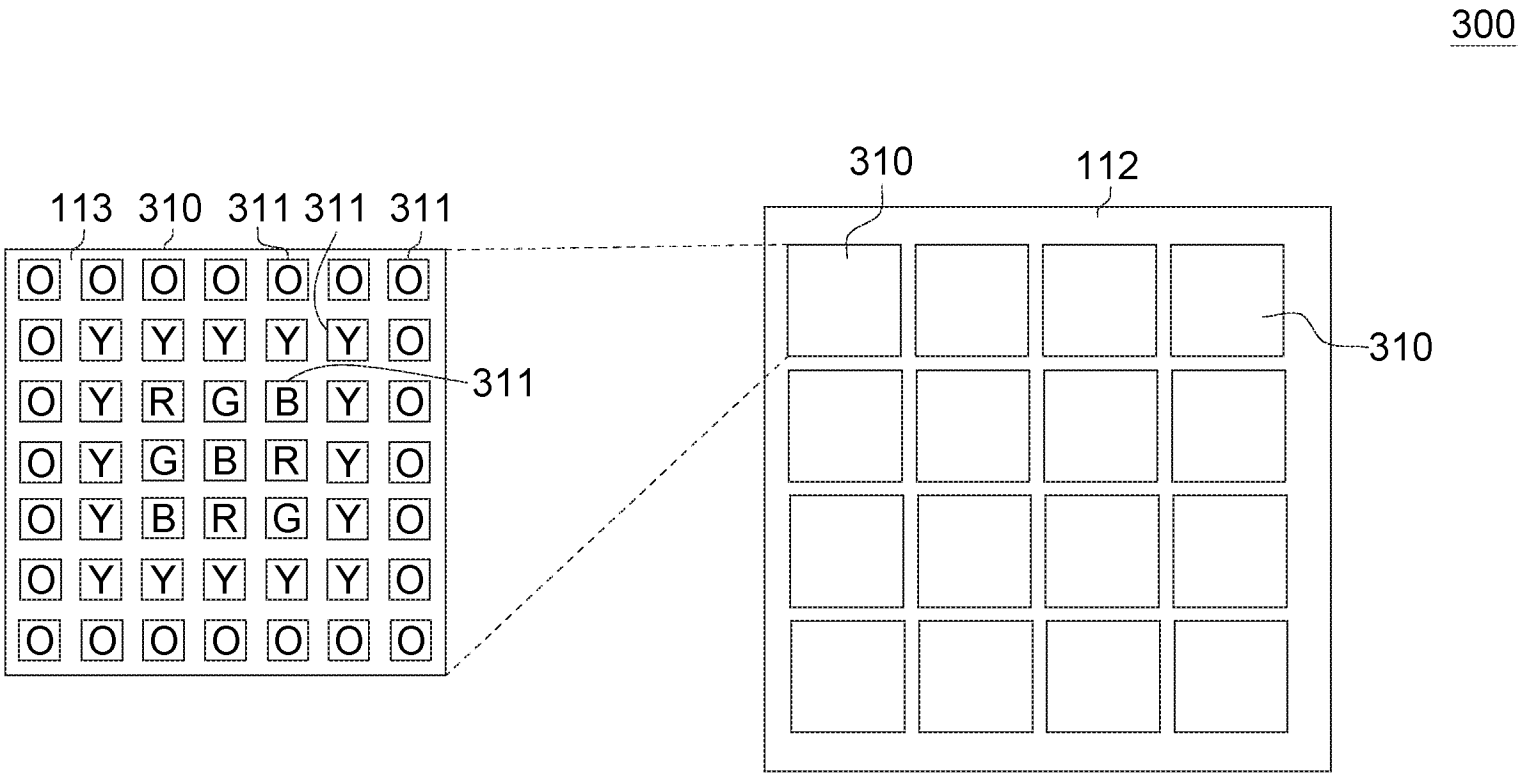
FIGS. 2, 3, 4, 5, 6, 7, 8, 9, 10, 11, 12, 13, 14, 15, 16A, 16B, 16C, 16D, 16E, 17, 18, 19A, 19B, 19C, and 19D show various embodiments of a lighting module.

Refer to FIG. 1 and FIG. 2. Exemplarily (but not restrictively), the lighting module 100 is formed by integrating more than one lighting sub-module 110 in a particular-material substrate 112.

Exemplarily, the lighting sub-module 110 is formed by integrating the LED chips with different wavelengths or color temperatures and the LED packages in the particular-material substrate 113.

The lighting module 100 can be modulized and manufactured by integrating the LEDs and the lighting sub-modules 110 by the substrate integrated process (such as all integrated circuit process).

A conductive structure or a non-conductive structure can be disposed on the surface or in the interior of the particular-material substrate 112 and particular-material substrate 113, wherein the particular-material substrate 112 and the particular-material substrate 113 can be made from such as a metal conductor, a semiconductor, a ceramic material, a polymer material or a composite material. An electrical circuit (conductive structure) can be disposed on the surface or in the interior of the particular-material substrate 112 and the particular-material substrate 113 and used as a power and electric controlling signal line or an optical interconnection optical path (such as the light guide structure) for transmitting an optical signal.

A plurality of lighting sub-modules 110 and a plurality of lighting modules 100 are connected via circuits (or referred as a conductive structure) or an optical path (or referred as a light guide structure). The circuits provide a power and an electric controlling signal. The optical path controls the transmission and feedback of an optical signal. The circuits can be electrically connected through electrical wire, electrical circuit or module connection circuit. The optical path can be connected for transmitting an optical signal through optical fiber, optical waveguide or module connection optical path, wherein the optical waveguide comprises a polymer optical waveguide, a chemical compound optical waveguide, and a semiconductor optical waveguide. If the light source module has the design for transmitting the optical signal, then the optical transmitter, the optical receiver and the photoelectrical signal converter can be integrated in the light source sub-module or the light source module for performing photoelectrical signal conversion. If all light source module is integrally manufactured by substrate integrated process, then the optical transmitter, the optical receiver and the photoelectrical signal converter can be integrated as a light source module by the all integrated circuit process. The electric signal of the lighting module 100 is processed and controlled by the electric controlling system 200. The lighting module 100 basically forms a spectrum whose wavelengths comprise a red light, a green light, a blue light, a yellow light, an orange light, a white light and so on. Or, a light source with another spectrum can be formed by mixing a red light, a green light, a blue light LED as a white light or mixing other LED lights with different wavelengths. Furthermore, the lighting module 100 can have different color temperatures. The lighting module 100 can concurrently emit a light with more than one wavelength or the color temperature. The formation of the lighting module 100 can include a far-infrared light LED, which is also used as a light source for controlling the growth of the plants (such as affecting the flowering of plants or the germination of seedlings) or a light source for the providing healthcare to people. For example, when the body is radiated by an infrared light, the skin will generate internal heat, pores will be expanded, perspirations will be secreted, metabolism will be stimulated and blood circulation will be accelerated, so as to convey oxygen and nutrition to the tissues, excrete metabolites with perspirations, replenish one's energy and relieve one from fatigue. The formation of the lighting module 100 can include an ultravelvet light LED, which is also used as a bactericidal or antibacterial light source (such as killing or suppressing the bacteria or germs in the air, water or surface of an object, or the plants or killing or suppressing insects or pests).

The electric controlling system 200 can comprise a lighting module control unit 210, a time domain control unit 220, an environment sensing unit 230, an operation controlling unit 240 and a memory database unit 250. The electric controlling system 200 can further comprise a module sensing unit 260. The functions of the above elements of the electric controlling system 200 are disclosed below.

The lighting module control unit 210 individually modulates the light quality, the light intensity and the color temperature of the light generated by each lighting sub-module 110 or the LED, or modulates the light quality, the light intensity and the color temperature of the light generated by part or all of the lighting sub-modules 110 or part or all of the LEDs to generate a light environment applicable to various scenarios. That is, the controlling method of the multi-function lighting system 1000 comprises the steps of modulating the light quality of the light generated by the lighting module 100; modulating the light intensity of the light generated by the lighting module 100; and modulating the color temperature of the light generated by the lighting module 100. For example, the lighting module control unit 210 individually modulates each lighting sub-module 110 or each LED, or concurrently modulates part or all of the lighting sub-modules 110 or part or all of the LEDs, so that the lighting module 100 generates a monochromic spectrum, a polychromic spectrum or a mixed light spectrum. Or, the lighting module control unit 210 adjusts the light intensity of the lighting module by way of individually modulating each lighting sub-module 110 or each LED or concurrently modulating part or all of the lighting sub-modules 110 or part or all of the LEDs.

The time domain control unit 220 controls each or part or all of the LEDs, each or part or all of the lighting sub-modules 110 and each or part or all of the lighting modules 100 according to a time parameter, so that the response of the light generated by the multi-function lighting system 1000 varies with the time. For example, the light quality and the color temperature of each lighting sub-module 110 or each LED can be started or turned off along with the time or the light intensity of each lighting sub-module 110 or each LED can be increased or decreased. Or, the light quality and the color temperature of part or all of the lighting sub-modules 110 or part or all of the LEDs can be started or turned off along with the time or the light intensity of part or all of the lighting sub-modules 110 or part or all of the LEDs can be increased or decreased.

The environment sensing unit 230 can integrate a temperature sensor, a humidity sensor, a light sensor, an object movement sensor, a voice sensor, a gas sensor and a signal transmitter/receiver for sensing an environmental condition and controlling the lighting module 100 accordingly. The environmental condition is such as a temperature (the temperature of the environment, or the temperature generated from human or an object), a humidity, a thermal energy, light environmental parameters (the spectrum, the light intensity, the light intensity or the color temperature), a sound signal (the volume, frequency or tone), components of air, the moving state of a human body in the space, the action of a human, or the combination thereof. For example, when the environment sensing unit 230 senses that a human body enters a room from another room, the environment sensing unit 230 turns on/off each, part or all of the LEDs, each, part or all of the lighting sub-modules 110, and each, part or all of the lighting modules 100. Or, after the environment sensing unit 230 senses the moving state of a human body in the space (the position in the space, the moving direction, or the relative position between the human body and the lighting module 100), or the action of the human body, the lighting module control unit 210 turn on each, part or all of the LEDs, each, part or all of the lighting sub-modules 110, and each, part or all of the lighting modules 100 which is the nearest, within a predetermined range, or located along the moving path. Or, after the environment sensing unit 230 senses that the temperature, the humidity or the light environment parameter (the light quality, the light intensity or the amount of light) is changed, the light color (the spectrum or the color temperature), or the light intensity of the light generated by the lighting module 100 is modulated accordingly. For example, during the office hours, the light source is a white light. When the outdoor sunlight shines in the indoors, the multi-function lighting system 1000 automatically reduces the light intensity of the white light generated by each, part or all of the LEDs, each, part or all of the lighting sub-modules 110, or each, part or all of the lighting modules 100 through the lighting module control unit 210. The light color and amount of sun light are changed in one day (from sunrise to sunset), and are changed in one year (four seasons). In a sunny day, clouds may shade the sun light, such that the light in the indoor environment will be changed accordingly. The environment sensing unit 230 senses the dynamic changes of the light environment parameters, and the multi-function lighting system 1000 can automatically modulate the light quality, the color temperature, or the light intensity of a light generated by each, part or all of LEDs, each, part or all of lighting sub-modules 110, or each, part or all of the lighting modules 100 through the lighting module control unit 210. Therefore, the light environment parameters can be controlled, and the sun light environment in different times during one day or different seasons during one year can be simulated. That is to say, the lighting module control unit 210 modulates the light quality, the light intensity and the color temperature of the white light generated by each, part or all of LEDs, each, part or all of lighting sub-modules 110, or each, part or all of the lighting modules 100, such that a cool white light, a warm white light or a simulated sun light which meets the setting of the light environment parameters can be generated and the power can be saved. Or, when the user would like to enter a relaxed or sleep state and there are indoor background lights, the multi-function lighting system 1000 automatically changes its photochromic matching and light intensity through the lighting module control unit 210. That is, when changes occur to the response of the light generated by the multi-function lighting system and the indoor background light environment, the multi-function lighting system automatically reduces or enhances the light color and the light intensity of the light generated by the lighting module 100 through the lighting module control unit 210. Or, if the sensor detects that the indoor temperature or humidity is too high and may easily make people feel irritated, then the lighting system automatically adjusts the light color and the light intensity of the light to low color temperature and middle illumination, so that people's mood can be pacified. That is, if the environment sensing unit 230 detects that the indoor temperature or humidity deviate from the comfort zone, then the multi-function lighting system 1000 automatically adjusts its photochromic matching and light intensity through the lighting module control unit 210, so that the generated light environment can make people feel comfortable. Or, suppose the setting of light environment is to enter a sleep state. If the environment sensing unit 230 senses that a human body turns over, this implies that the user has not yet entered the sleep state or the sleep is still very light, then the multi-function lighting system 1000 does not modulate the original light environment for the sleep state, but automatically delay and change the modulation time of the light environment for the sleep state and the light source modulation periodical setting.

Or, in the memory database unit 250, the relationship between the light parameter (the light quality or the light intensity) and the amount of reduced carbon dioxide, increased oxygen or eliminated volatile organic compounds (VOCs) which are caused by plants is stored. Suitable plants can be placed at suitable locations where the plants are projected suitable light, such that the carbon dioxide can be reduced, the oxygen can be increased, or the volatile organic compounds (VOCs) can be eliminated. If the environment sensing unit 230 senses that the concentration of the carbon dioxide or the concentration of the volatile organic compounds (VOCs) is more than the light environmental parameter, or the concentration of the oxygen is less than the light environmental parameter, the lighting module 100 outputs a suitable light environmental condition according to the light environmental parameter stored in the memory database unit 250. The light system can modulate the light intensity, light quality or the turn-on duration according to the light environmental parameter stored in the memory database unit 250, for reducing the carbon dioxide, increasing the oxygen, and eliminating the volatile organic compounds (VOCs). Moreover, the light source of the lighting module 100 can be a combination of an UV light and the photocatalyst, or a combination of a visible light and the photocatalyst, for killing bacteria, such as Bacterioplankton, and decomposing gas, such as Ethylene which can ripen fruits and vegetables. If Ethylene exists in the air, fruits and vegetables will be corrupted. When the environment sensing unit 230 senses that Ethylene is existed near the fruits and vegetables, the lighting module 100 may project a light which is a combination of an UV light and the photocatalyst on the fruits and vegetables for decomposing Ethylene. Therefore, the shelf life of fruits and vegetables can be extended. Besides, the lighting module 100 can be generated red light, blue light, white light, different mixing ratio of red and blue light or other light, to modulate the photosynthesis, functional ingredients and pigments of fruits and vegetables. By the way, the fruits and vegetables can be enhanced the preservation capability and functional ingredients benefit human.

Or, the environment sensing unit 230 can sense the sound signal, and further to control the light environmental parameter of the lighting module 100. For example, the light can be brighten, darken or turned off, according to whether the door is opened or closed. When the environment sensing unit 230 senses the sound signal which is generated by opening or closing the door, the lighting module control unit 210 modulates each, part or all of the LEDs, each, part or all of the lighting sub-modules 110, and each, part or all of the lighting modules 100. Besides, the action of a user can be determined by analyzing the sound signal, and then the light can be controlled by the lighting module 100. For example, the sound signal may be generated by a user in the space. The command may be "turn on the light", "turn off the light" or "change the color of the light." The light can be set according to a command analyzed from the sound signal. According to the sound parameter of a particular person, it can be determined that the sound signal is generated by the particular person. The multi-function lighting system 1000 can be limited to be controlled by the particular person, such as family members or employees, for power saving or security management.

Figure 3:
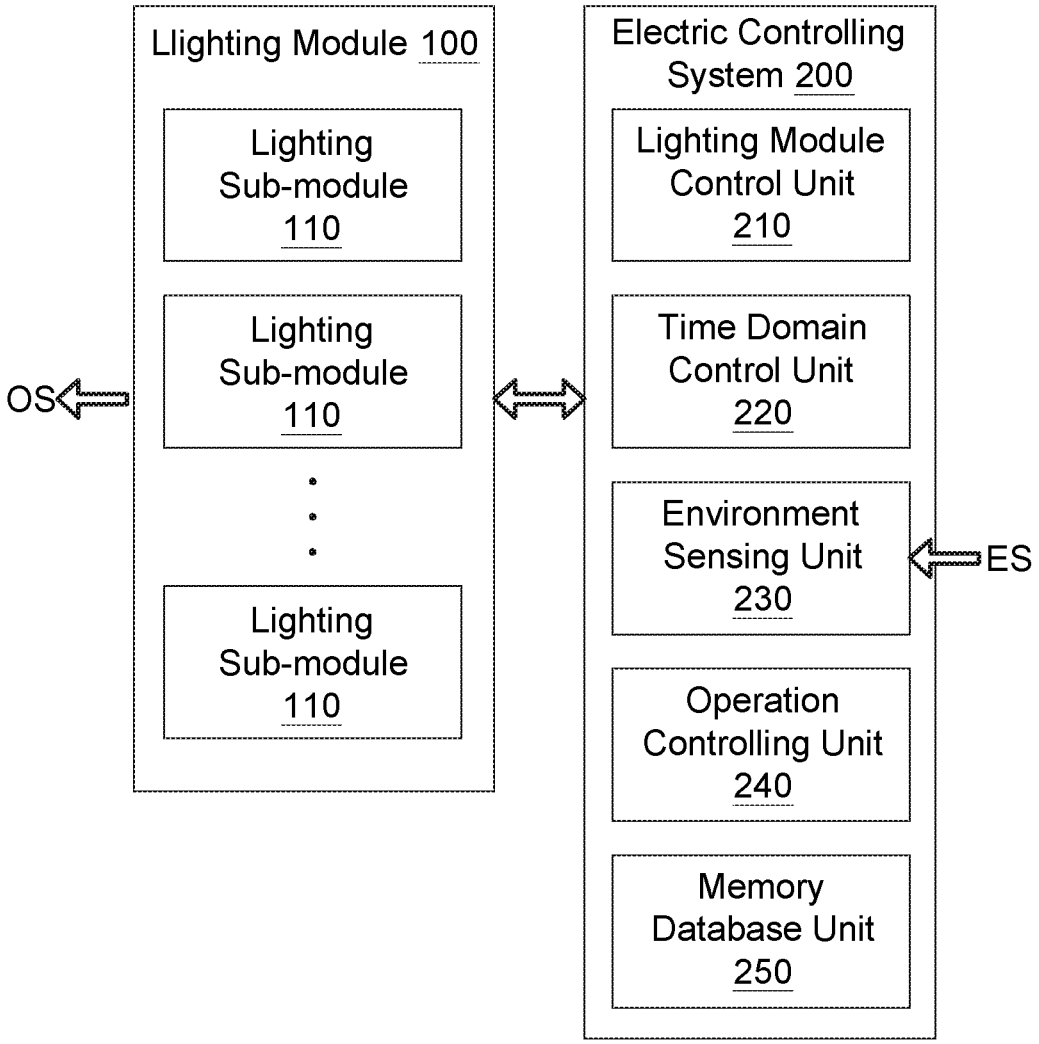
Figure 4:
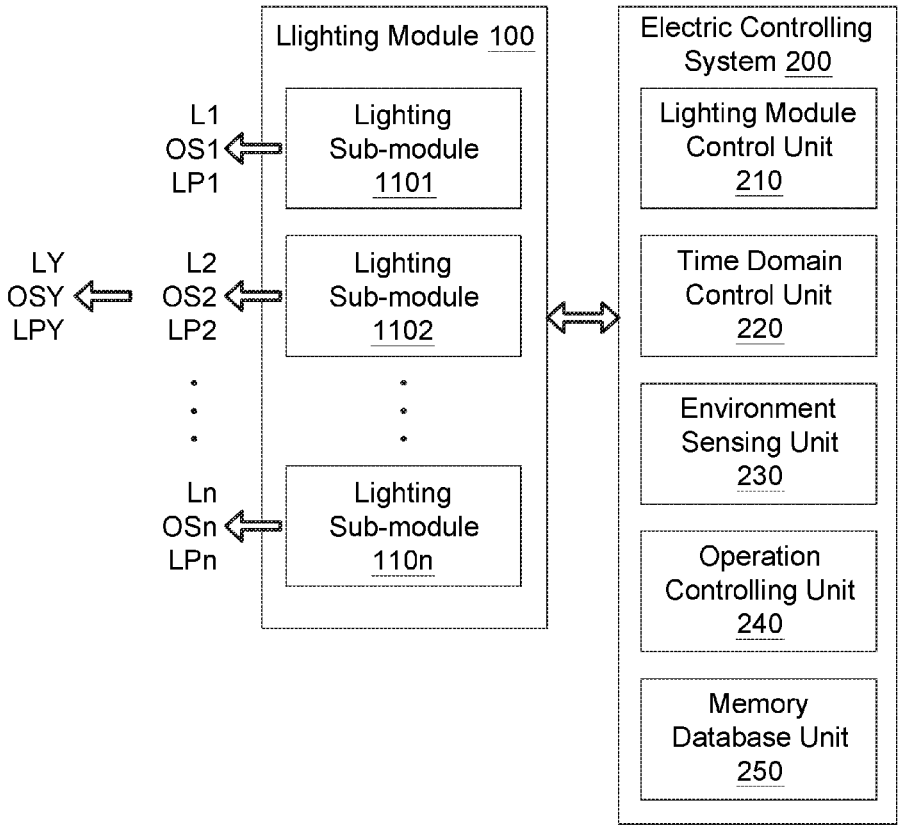

The signal transmitter/receiver transmitting of the environment sensing unit 230 not only transmits and receives the sensing parameters, but also transmits and receives electromagnetic ES and/or sound signals SS which can be transmitted by a wire line or a wireless channel. For example, as shown in FIG. 3, for an electromagnetic signal ES generated by a wearable device which can detect the physical and psychological state of human is transmitted to the environment sensing unit 230 for modulating the light. Or, a particular person, such as family members or employees can wear an Internet of Things device (IoT device), and the environment sensing unit 230 obtains the moving path, the relative location and the retention time through the electromagnetic signal ES to modulate the light for power saving or security management. Or, after the environment sensing unit 230 receives the electromagnetic signal ES or sound signals SS, the lighting module control unit 210 modulates each, part or all of the LEDs, each, part or all of the lighting sub-modules 110, and each, part or all of the lighting modules 100 to output an optical signal OS. As shown in FIG. 4, light LY is the light parameter generated by the lighting sub-module 1101 to 110*n*. The light LY includes the spectrum, the luminous flux of the spectral light, the luminous flux of the total light, the light intensity of the spectral light, the light intensity of the total light, and the color temperature. The lights L1, L2 to Ln are the light parameter (the spectrum, the luminous flux of the spectral light, the luminous flux of the total light, the light intensity of the spectral light, the light intensity of the total light, or color temperature) of the lighting sub-modules 1101, 1102 to 110*n* respectively. The optical signals OS1, OS2 to OSn are generated by the lighting sub-modules 1101 to 110*n*. The optical signal OSY is the optical signal generated by the lighting sub-modules 1101 to 110*n*. The optical signal OSY includes varied signals generated by LEDs having different spectrums. The optical signals OS1 to OSn include varied signals generated by LEDs having different spectrums. Light picture LPY is the light frame, which are static or dynamic, generated by the lighting sub-modules 1101 to 110*n*. The light picture PLY includes the light shapes, the light patterns, the drawings, the images, the animations, the numbers, and the words. Light pictures LP1, LP2 to LPn are light frames, which are static or dynamic, generated by the lighting sub-modules 1101 to 110*n* respectively. The light pictures LP1 to LPn include the light shapes, the light patterns, the drawings, the images, the animations, the numbers and the words.

The operation controlling unit 240 modulates the light quality, the light intensity and the color temperature of the light generated by the lighting module 100 according to a setting of light environment. The operation controlling unit 240 performs modulation in an automatic or artificial way. The operation controlling unit 240 can modulate the lighting module 100 through cabled transmission or wireless transmission, wherein the user can modulate the light source through a hand-held device, a wearable device, or a movable device having a remote control function. Or, the user can modulate the light sources through network.

The memory database unit 250 stores the light output parameters and the operation conditions of the multi-function lighting system 1000 in different situations. The memory database unit 250 has a calculating function for providing the best operating way. For example, through 24 hour light environment sensing, the lighting module 100 can set and store the optimum value of the light environment time domain parameter, such as the time for automatically modulating the spectrum and the light intensity of the light generated by the light source. Or, the user can adjust his/her personal preference, and the memory database unit 250 automatically records the user's personal preferences accordingly.

Figure 5:
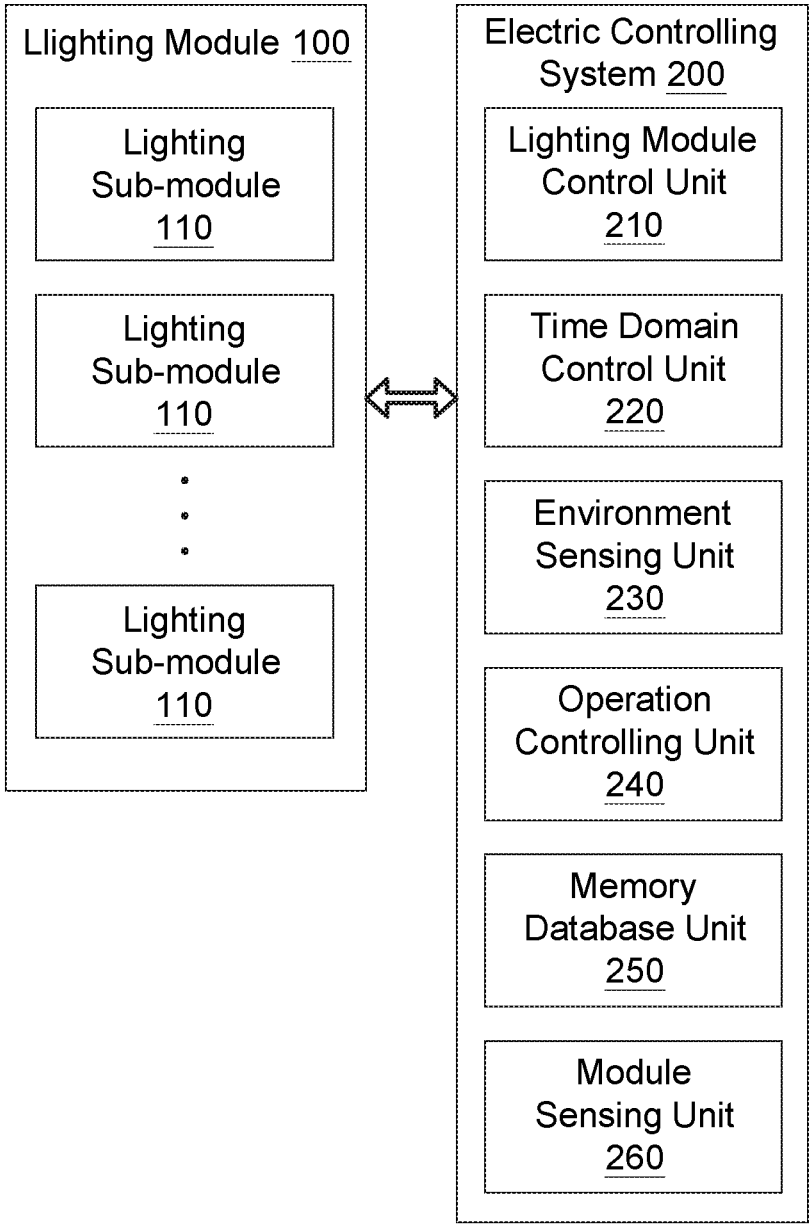
Figure 6:
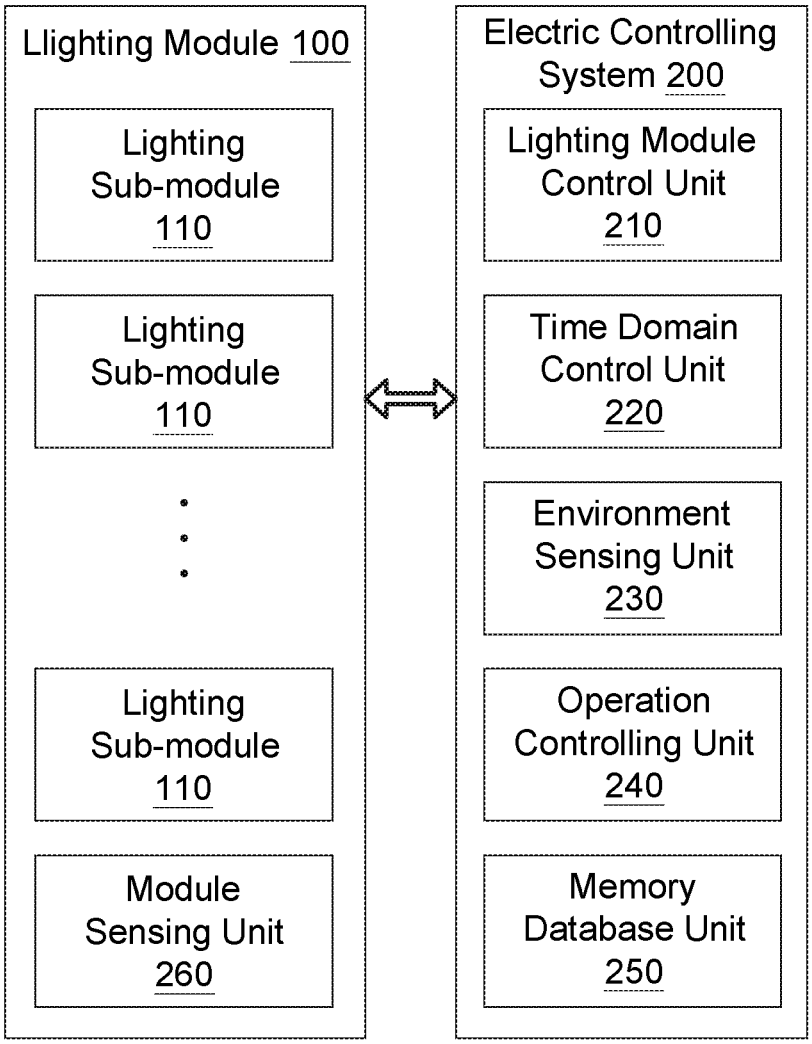

A module sensing unit 260 is used for sensing the temperature and the electric performance of the lighting modules 100, the light sub-modules 110 and the LEDs. The temperature and the electric performance of the lighting modules 100, the light sub-modules 110 and the LEDs can be monitored. If the temperature is too high, the circuit is failed, or the optical performance is declined, the lighting module 100, part of the lighting sub-modules 110 or part of the LEDs can be controlled to be turned off or reduce the light intensity, a record is made, and a notification is sent to the system administrator. As shown in FIG. 5, the module sensing unit 260 can be integrated into the electric controlling system 200. Or, as shown in FIG. 6, the module sensing unit 260 can be integrated into the lighting module 100.

The lighting module 100 of the disclosure can be manufactured in a customization way to meet the diversified needs of the lamps. Thus, the LEDs, the lighting sub-modules 110 and the lighting module 100 can be combined according to actual needs so as to generate various light environments with different qualities, light intensity, color temperatures, and light shape, patterns, images, drawings, animations, videos, numbers, words. Let FIG. 2 be taken for example. The lighting module 300 is formed by a plurality of lighting sub-modules 310 arranged in the form of a matrix. The lighting sub-modules 310 are formed by the red, the green, the blue, the yellow and the orange light LEDs 311 ("R" denotes a red light, "G" denotes a green light, "B" denotes a blue light, "Y" denotes a yellow light, "O" denotes an orange light). The red, green and blue light can be mixed as a light source with a white light spectrum. The red light, the green light and the blue light can be mixed to be a white light. The lighting module control unit controls the combination of the lighting modules, the light sub-modules and the LEDs having different wavelengths, such that the sun light in one day (from sunrise to sunset) can be simulated. For example, the wavelength of the sun light in one day ranges from 400 nm to 700 nm. The lighting module control unit 210 can simulate the sun light in one day by at least two kinds of LEDs whose wavelengths are different and Fall Width Half Maximum (FWHM) is within 40 nm. The light quality, the color temperature and light intensity of the light in the environment can be monitored by the environment sensing unit, and the light in the environment can be modulated dynamically according to the data stored in the memory database unit 250.

Figure 7:
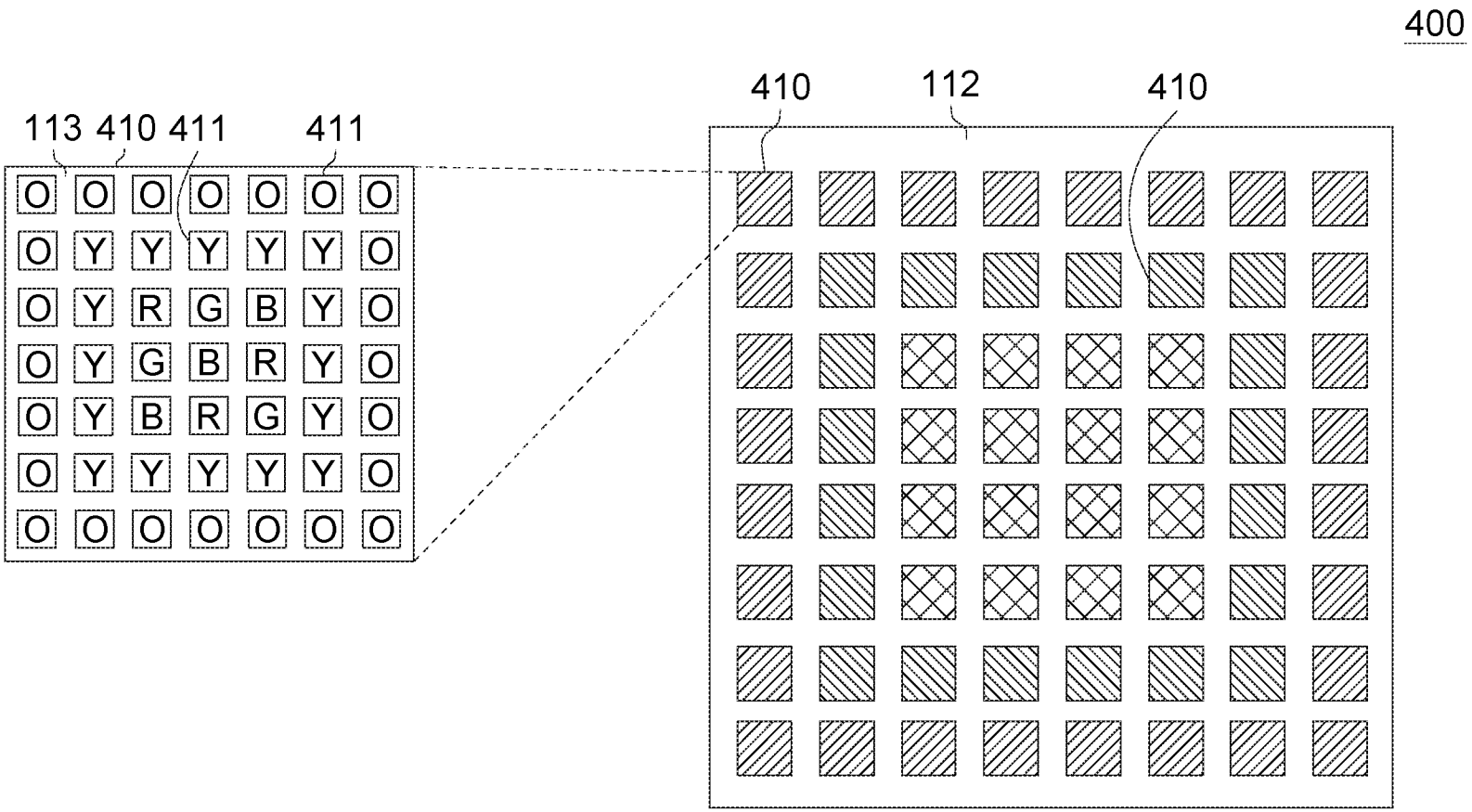

Let FIG. 7 be taken for example. The lighting module 400 can be formed by three color temperatures or even more light sub-modules 410 (in FIG. 7, different shadings indicate different color temperatures). The LEDs 411 can have many distributions of color temperatures and spectrums, which further form different combinations of conditions for the required light sources.

Figure 8:
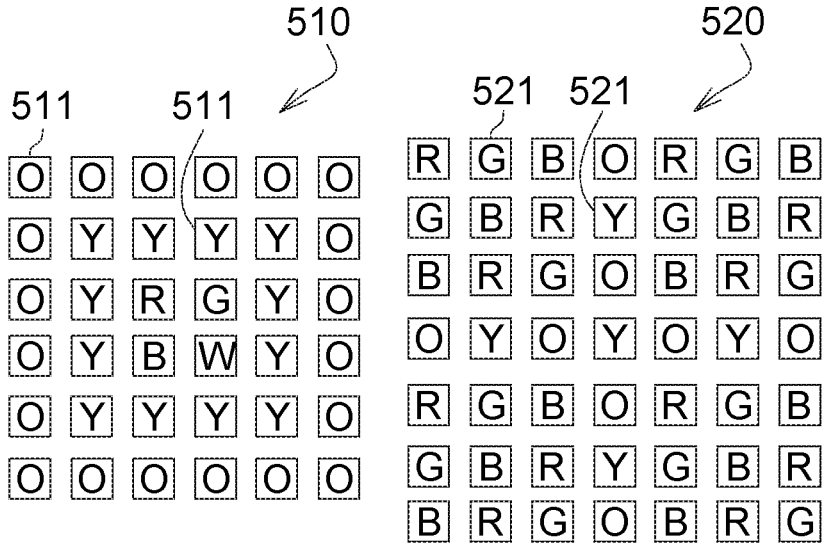

Let FIG. 8 be taken for example. The lighting sub-modules 510 and 520 can be arranged in a multiplex configuration. Let the lighting sub-modules 510 disposed at the left-hand side of FIG. 8 be taken for example. The lighting sub-modules 510 can be formed by the red, the green, the blue, the white, the yellow and the orange light LEDs 511 ("W" denotes a white light). Let the lighting sub-modules 520 disposed at the right-hand side of FIG. 8 be taken for example. The lighting sub-module 520 can be formed by a multiplex configuration of the red, the green, blue, the yellow and the orange light LEDs 521.

Figure 9:
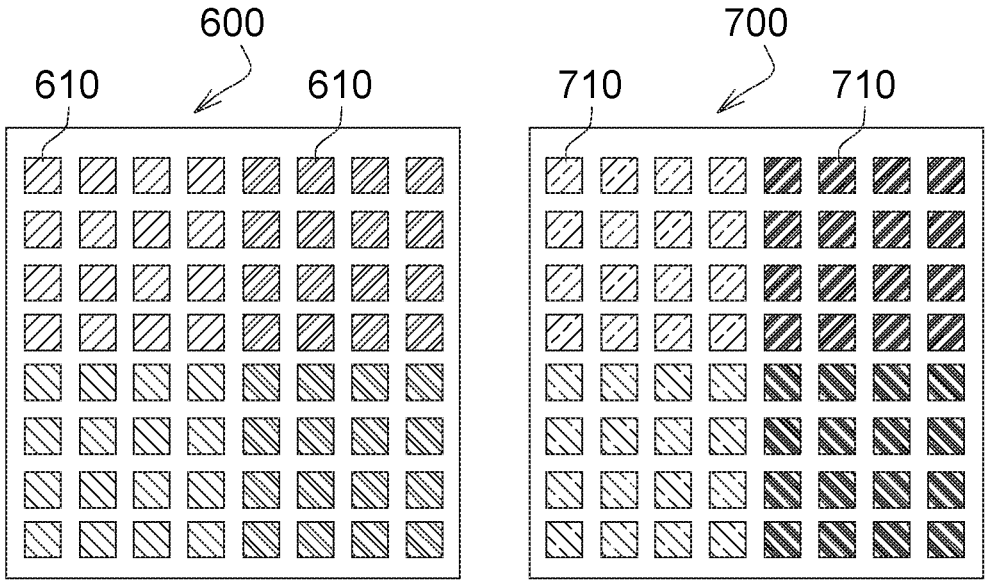

Let FIG. 9 be taken for example. The lighting module 600 disposed at the left-hand side of FIG. 9 can be formed by the light source sub-modules 610 with different colors (different net points indicate different colors). The lighting module 700 disposed at the right-hand side of FIG. 9 can be formed by the lighting sub-modules 710 with different color temperatures (different net points indicate different color temperatures).

Figure 10:
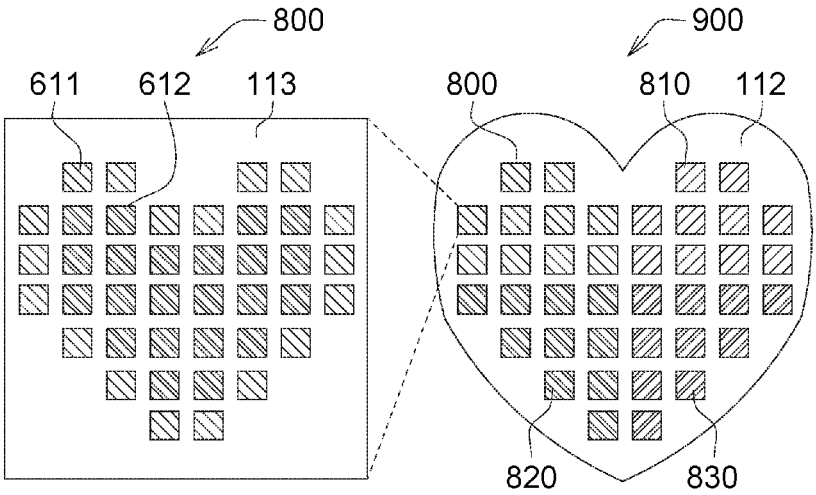

Let FIG. 10 be taken for example. The lighting sub-modules 800 disposed at the left-hand side of FIG. 10 can be formed by the LEDs 611 and 612 different spectrums or color temperature (different net points indicate different spectrums or color temperatures). The lighting modules 900 disposed at the right-hand side of FIG. 10 can be formed by the lighting sub-modules 800, 810, 820 and 830 with different color temperatures or colors (different net points indicate different color temperatures or spectrums). Different patterns (such as the heart patterns) of colors or color temperatures can be generated through various dispositions or arrangements of the LEDs 611 and 612 and the lighting sub-modules 800, 810, 820 and 830.

Figure 11:
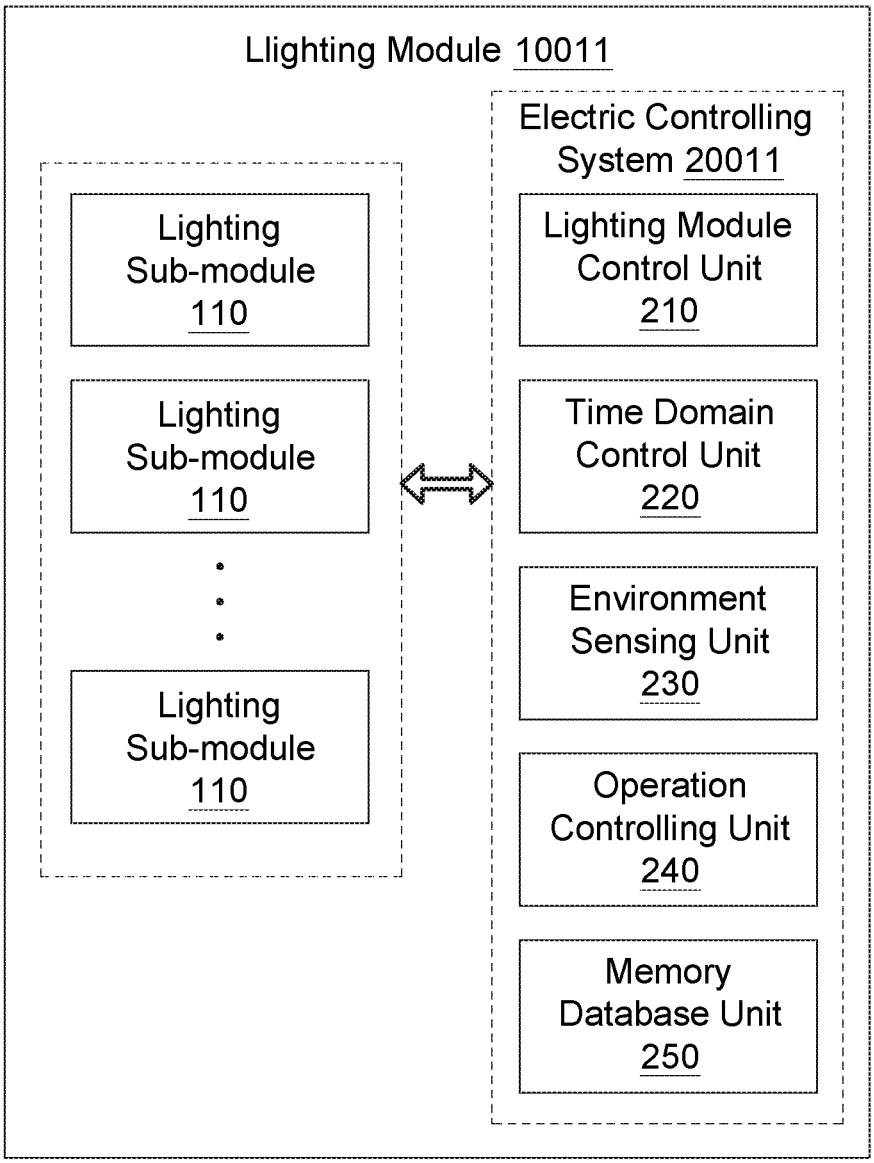
Figure 12:
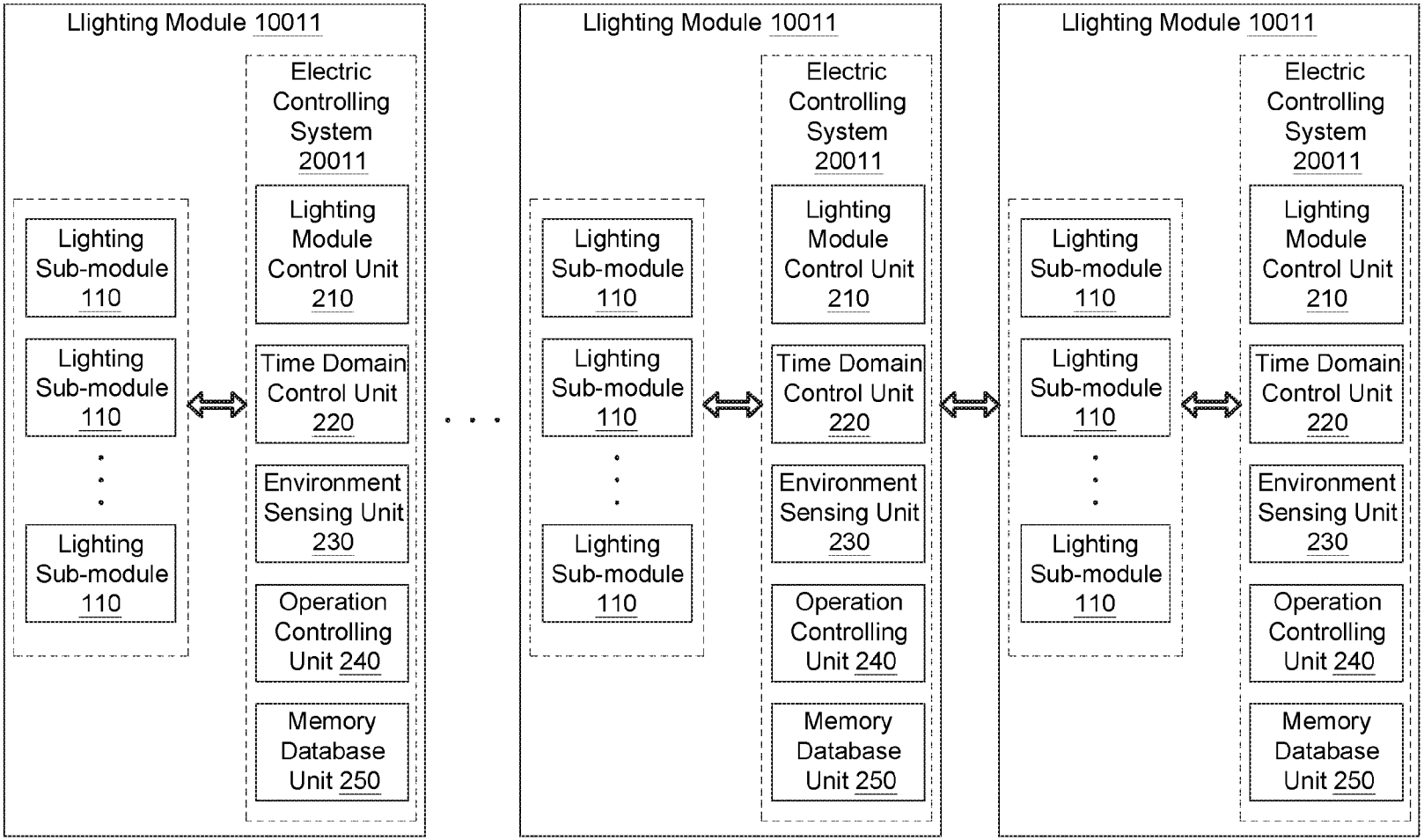

FIG. 11 shows a lighting module 10011 according to another embodiment. The lighting module 10011 includes one or more than one light sub-modules 110 and an electrical controlling unit 20011. The electrical controlling unit 20011 includes the lighting module control unit 210, the time domain control unit 220, the environment sensing unit 230, the operation controlling unit 240 and the memory database unit 250. Furthermore, the electrical controlling unit 20011 may further include a module sensing unit. As shown in FIG. 12, the multi-function lighting system can include one or more than one lighting modules 10011.

The lighting module control unit can modulate the light quality, the light intensity and the color temperature of each light sub-module or each LED, or modulate the light quality, the light intensity and the color temperature of part or all of the light sub-modules, or part or all of the LEDs, to generate lights which are suitable for different situations. That is to say, the controlling method of the multi-function lighting system includes the step of modulating the light quality of the lighting module, the step of modulating the light intensity of the lighting module, and the step of modulating the color temperature of the lighting module. For example, the lighting module control unit modulates each lighting sub-module or each LED individually, or modulates part or all of the lighting sub-modules, or part or all of the LEDs, such that the lighting module can generate a light having single color spectrum, a light having multicolor spectrum or a light having mixed color spectrum. Or, the lighting module control unit modulates each lighting sub-module or each LED individually, or modulates part or all of the lighting sub-modules, or part or all of the LEDs, such that the light intensity can be adjusted.

Figure 13:
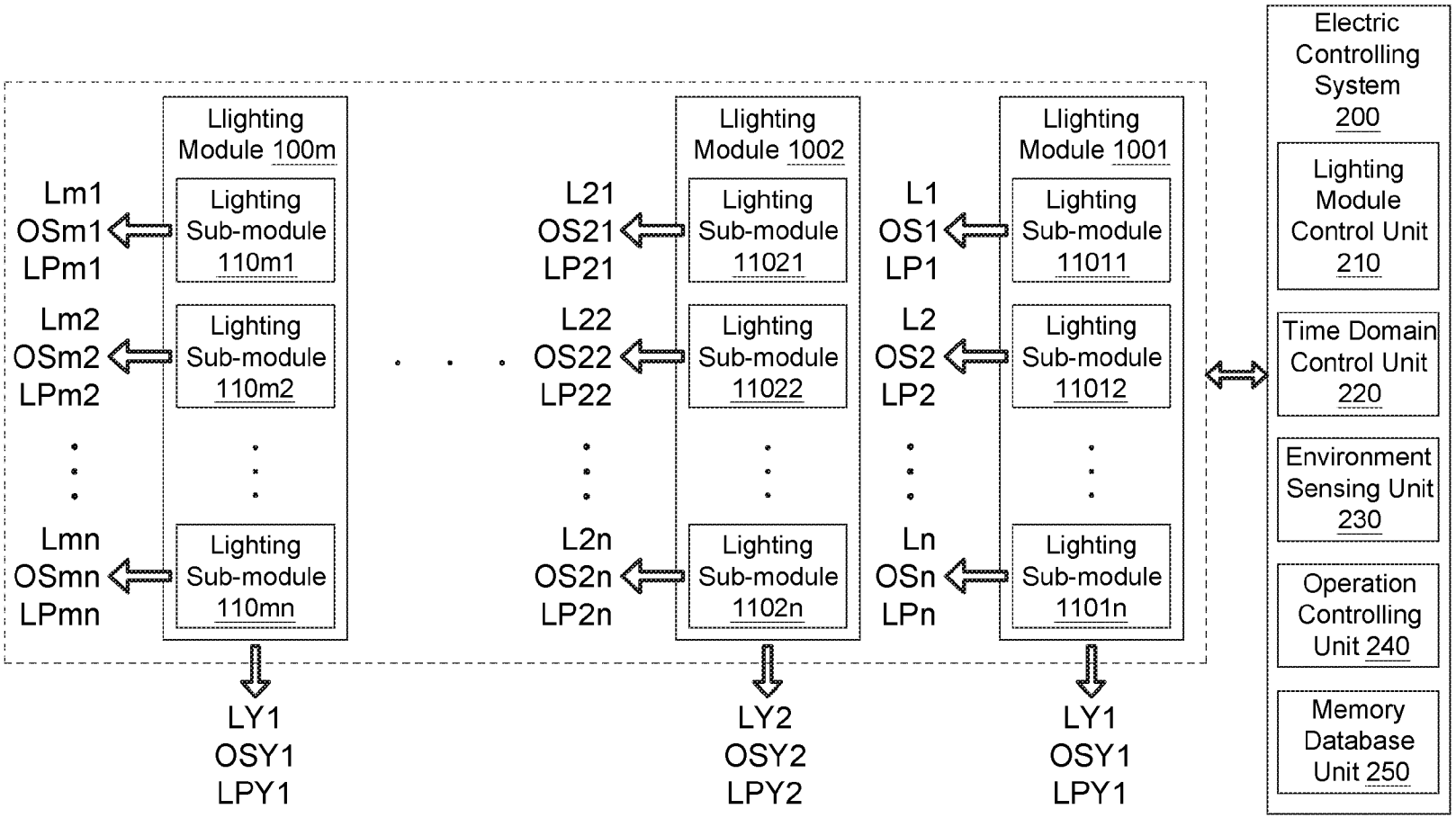

FIG. 13 shows a multi-function lighting system according to one embodiment. Lights L11, L21 to Lm1 are the light parameters of the lighting modules 1001, 1002 to 100*m* respectively. The light parameters include the spectrum, the luminous flux of the spectral light, the luminous flux of the total light, the light intensity of the spectral light, the light intensity of the total light, and the color temperature, of the lighting sub-modules 11011, 11012 to 1101*n*, 11021, 11022 to 1102*n*, 110*m*1, 110*m*2 to 110*mn*. Optical signals OS11, OS12 to OS1*n*, OS21, OS22 to OS2*n*, OSm1, OSm2 to OSmn are optical signals generated by the lighting sub-module 11011, 11012 to 1101*n*, 11021, 11022 to 1102*n*, 110*m*1, 110*m*2 to 110*mn* respectively. Light pictures LP11, LP12 to LP1*n*, LP21, LP22 to LP2*n*, LPm1, LPm2 to LPmn are light frames generated by the lighting sub-modules 11011, 11012 to 1101*n*, 11021, 11022 to 1102*n*, 110*m*1, 110*m*2 to 110*mn* respectively. The light pictures LP11, LP12 to LP1*n*, LP21, LP22 to LP2*n*, LPm1, LPm2 to LPmn, which are static or dynamic, include the light shapes, the light patterns, the drawings, the images, the animations, the numbers, and the words.

The present disclosure can be applied on lighting, display and communication. The size and the number of the lighting module 100, the lighting sub-module and the LEDs/multi-chip package LEDs having different spectrums or color temperatures can be changed. Furthermore, the distance among lighting modules, lighting sub-modules, LEDs/multi-chip package LEDs, also can be changes. For example, the lighting module 100, the lighting sub-module 110 and the LEDs having different spectrums or color temperatures can be fabricated in different distances thereof, different positions thereof, different shapes thereof, and different areas. The lighting module controlling unit 210 modulates the part or all of lighting module, the part or all of lighting sub-module, or each, part or all of the LEDs/multi-chip package LEDs, such that the lighting module can display one or several static/dynamic light frames having different sizes, different resolutions, different colors, different spectrums, different color temperatures and different brightness. The light frame can be light shape, pattern, image, animation, number or word. The brightness and the speed of change of the light frame can be controlled by the lighting module controlling unit 210. The light frame can be changed automatically or manually according to the change of the environment. The resolution of the light frame can be modulated through the intensity of the lighting module 100, the intensity of the lighting sub-module 110, the intensity of the LEDs or the size of each LED. The softness of the light frame can be modulated through the color, the brightness, and reducing glare. The frequency of the light frame is high enough to avoid any flicker. The brightness and the color of the lighting frame can be modulated according to the change of the light in the environment. The lighting module controlling unit 210 can automatically modulate the light frame according to the best parameter stored in the memory database unit 250.

Figure 14:
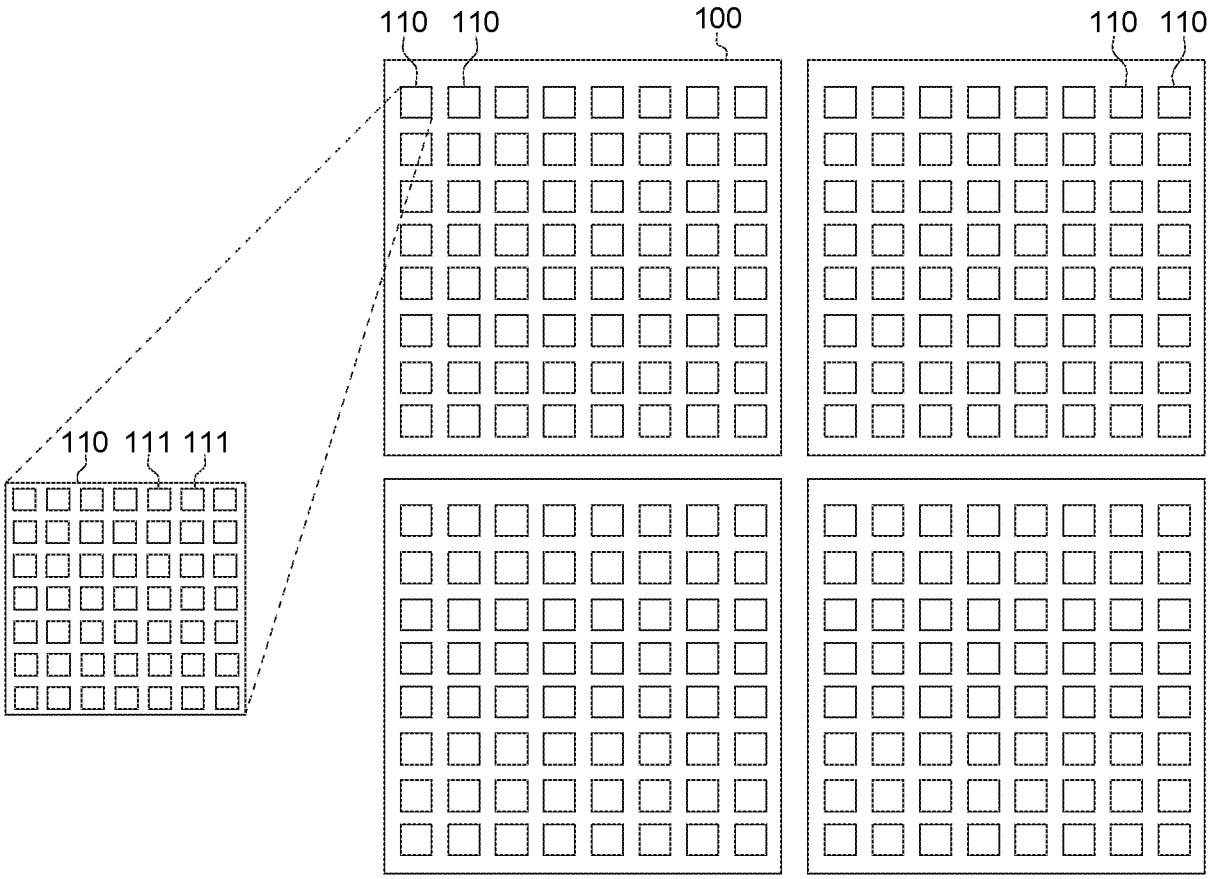

As shown in FIG. 14, one lighting module 100 includes several lighting sub-modules 110. One lighting sub-module 110 includes several LEDs/multi-chip package LEDs 111 having different spectrums or color temperatures. The size, the number and distance of the lighting module, lighting sub-module and the LEDs/multi-chip package LEDs can be changed. Besides, the distance between lighting module and lighting module, lighting sub-modules and lighting sub-modules, the LEDs and LEDs (include multi-chip package LEDs) also can be changes. The various light frames can be generated by part or all of lighting module 100, the part or all of lighting sub-module 110, or each, part or all of the LEDs/multi-chip package LEDs. The light frames can be display static, dynamic or simultaneous.

Figure 15:
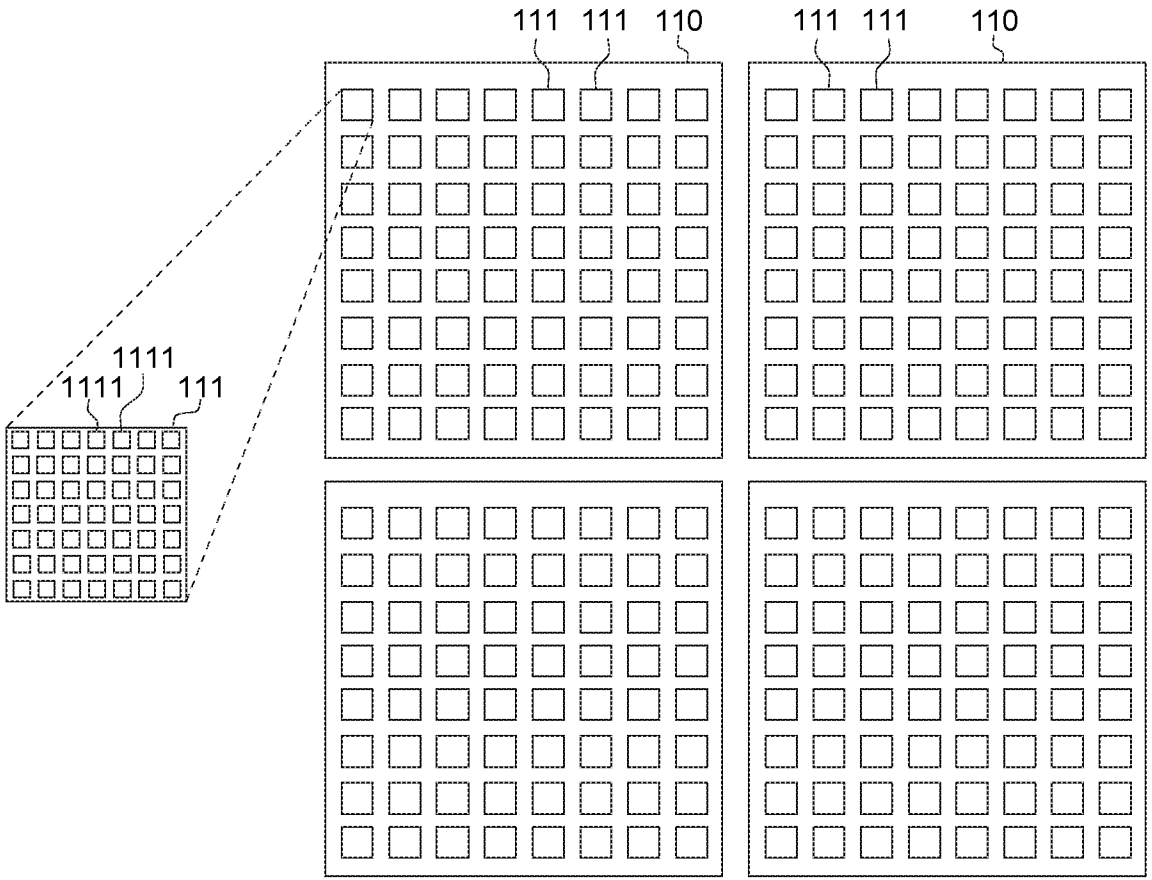
Figure 16A:
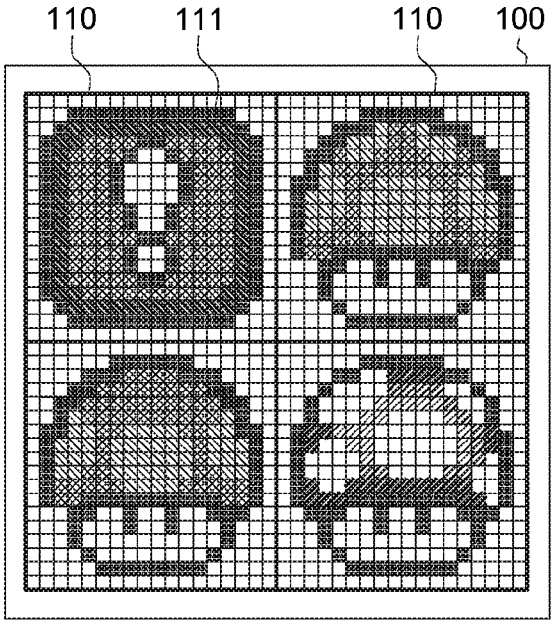
Figure 16B:
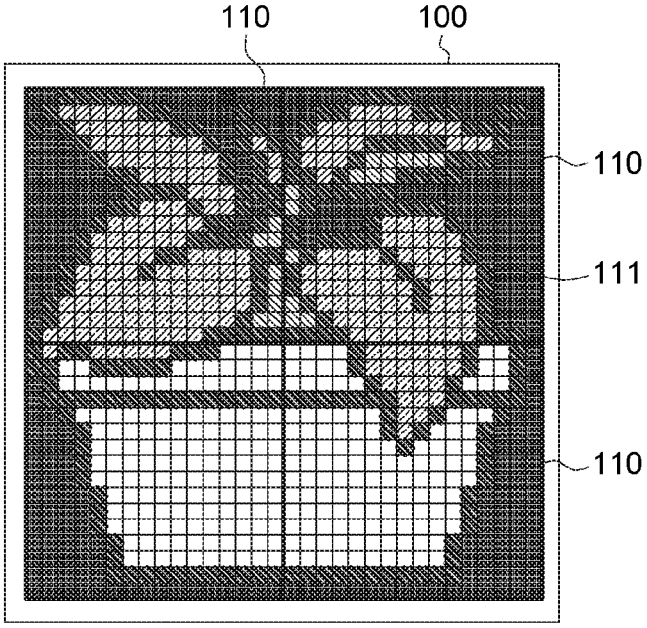
Figure 16C:
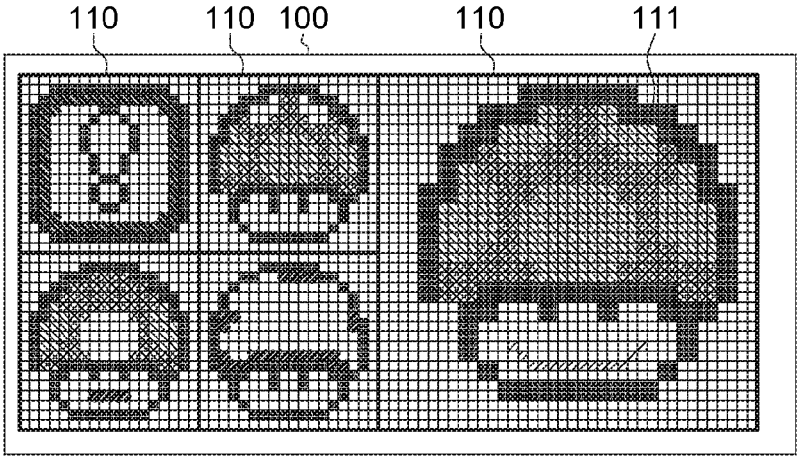
Figure 16D:
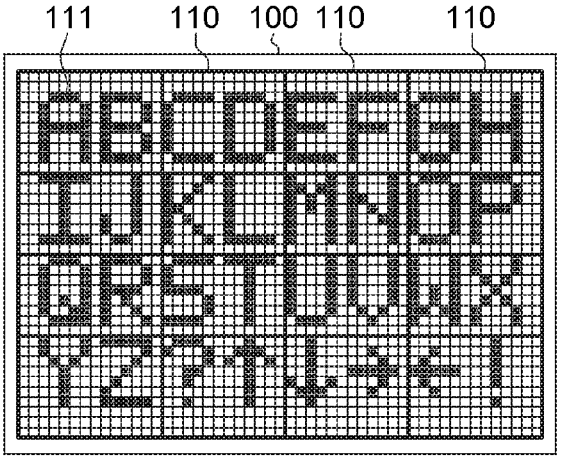
Figure 16E:
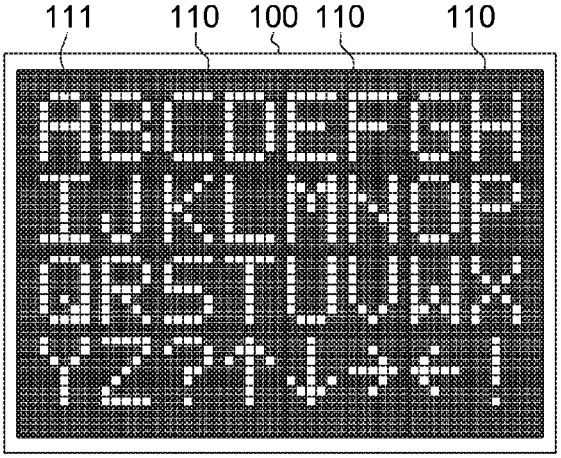

As shown in FIG. 15, one lighting sub-module 110 includes several multi-chip package LEDs 111 with different spectrums or color temperatures. One multi-chip package LED 111 includes several LEDs 1111 having different spectrums or color temperatures. The size, the number and distance of the lighting sub-module and the LEDs/multi-chip package LEDs can be changed. Besides, the distance between lighting sub-modules and lighting sub-modules, the LEDs and LEDs (include multi-chip package LEDs) also can be changes. The various light frames which are can be generated by part or all of lighting sub-module 110, or each, part or all of the LEDs/multi-chip package LEDs. The light frames can be display static, dynamic or simultaneous.

As shown in FIGS. 16A to 16E, the lighting module controlling unit 210 can control the lighting module 100 and each of the lighting sub-modules to show the light shapes, the light patterns, the drawings, the images, the animations, the numbers, and the words, which are static, dynamic or simultaneous. For example, cartoon characters, English letters, Chinese characters, world maps, or symbols can be shown.

As shown in FIGS. 16A to 18, the lighting module controlling unit 210 modulates part or all of lighting module, part or all of lighting sub-module, part or all of the LEDs/multi-chip package LEDs, such that the lighting module shows a light frame generated by one static/dynamic frame, several static/dynamic frames, or the combination thereof. This light frame can be used to perform a particular information communication function. The frequency of the light frames is higher than a frequency that the human eyes can aware.

In the present disclosure, one lighting module or more than one lighting modules generate a series of regular and meaningful light messages during a period of time. The light message may include lights having different wavelengths and different optical communication rates. The light source of light message may include red light, green light, blue light, UV light, IR light or any combination thereof. The light message may be shown by controlling the light flux, the brightness, the shape, the area, the display time, the frequency, the display order, or any combination thereof of each, part or all of the lighting modules/light sub-modules/LEDs (include multi-chip package LEDs). The light shapes, the light patterns, the drawings, the images, the animations, the numbers, and the words can be obtained from the light message through an algorithm by a light flux measuring device, an image capturing device or a camera. Those, the light message can carry a data.

Figure 17:
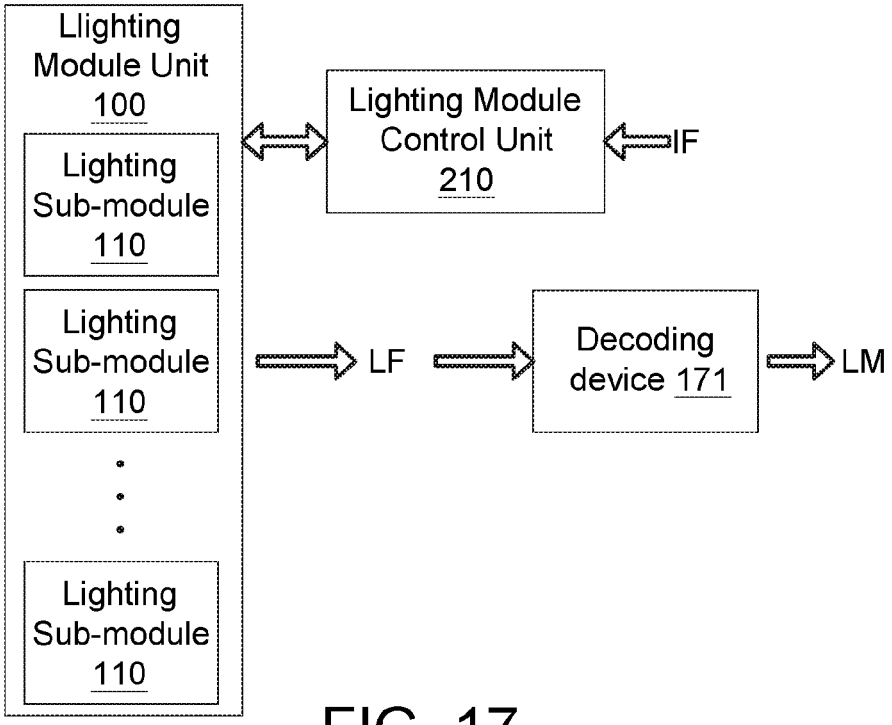

For example, as shown in FIG. 17, when an information IF is needed to be transmitted, the lighting module controlling unit 210 modulates the light frames to generate the light patterns, the drawings, the images, the animations, the numbers, and the words. The light frames LF are shown according some regular and meaningful changes. The changes of the light frames LF can be analyzed to obtain the light message LM by a decoding device 171.

Figure 18:
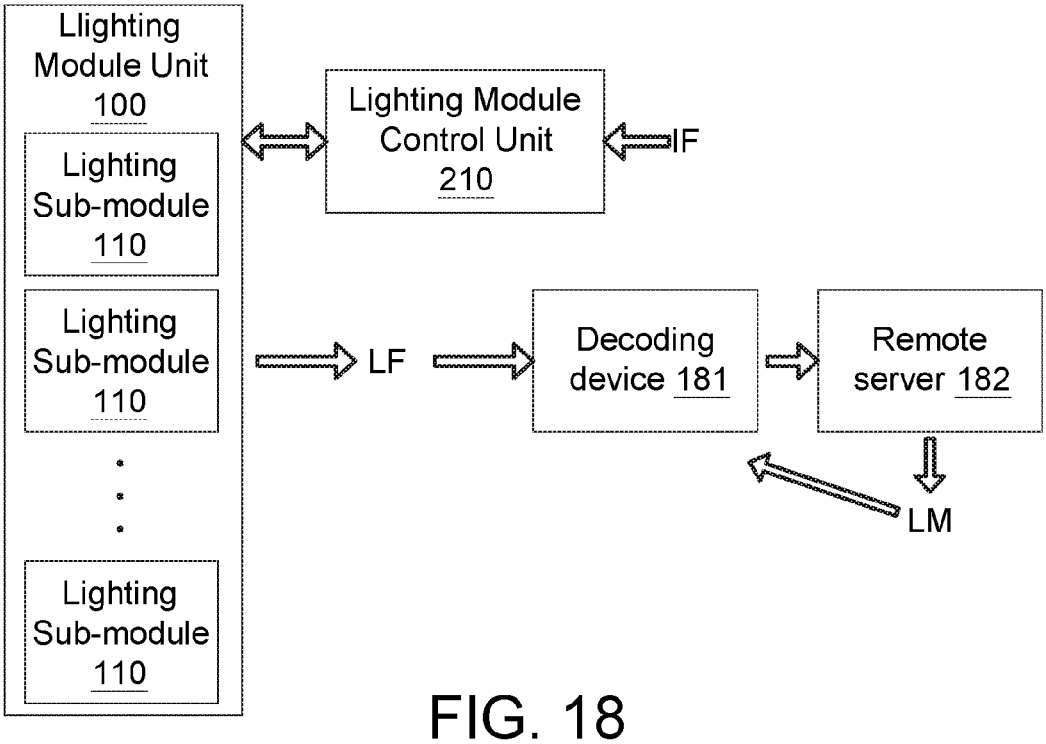

As shown in FIG. 18, the decoding device 181 can decode the light frames LF by a remote server 182. The decoding device 181 can be a wearable device, such as a glasses or a helmet.

Moreover, when a high brightness light is directly projected to the human eyes, it is discomfort for the human eyes. Moreover, the visual function of the human eyes may be decreased. This phenomenon is called glare.

Therefore, if the contrast difference or the brightness difference of the light in a space is too large, it may cause glare. According to the contrast difference or the brightness difference in the space, the brightness and the beam angle of the light are adjusted for preventing from the glare.

If the beam angle or the distribution is not suitably arranged, it may cause glare. For preventing from the glare, a uniform light is needed.

Reasons caused the glare include the brightness of the light, the location of the light, the uniformity of the light, the number of the lights, and the environment. For example, if the brightness of the light is high, the light is near the eyes, the uniformity of the light is large or the environment is dark, the glare may be obvious.

The glare can be determined by calculating the unified glare ratio (UGR) which is provided by CIE. If the UGR is less than 9, then human may feel dark. If the UGR ranges from 10 to 15, then human may feel comfortable. If the UGR ranges from 16 to 21, then human may feel tired. If the UGR ranges from 22 to 27, then human may feel uncomfortable slightly. If the UGR is larger than 28, then human may feel uncomfortable. Therefore, the best range of the UGR for preventing from the glare is 10 to 15.

Furthermore, the lighting module 100 may further includes a wireless charging unit. The lighting module 100 including the wireless charging unit can be disposed near a wireless charger without any wire. The wireless charger can provide electric power without power line for lighting module 100 and/or other device/unit of lighting system 1000. Therefore, the user/designer can easily change the arrangement of the lighting module 100/lighting system 1000.

Figure 19A:
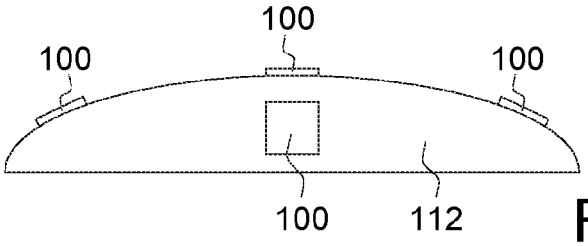
Figure 19B:
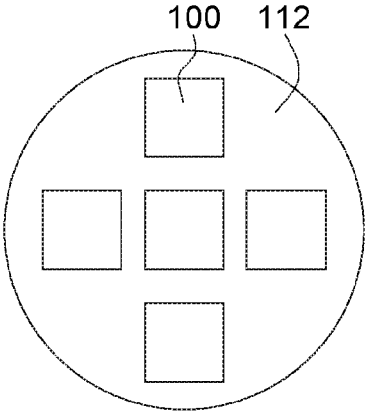
Figure 19C:
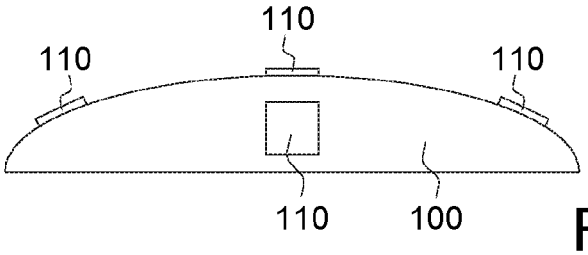
Figure 19D:
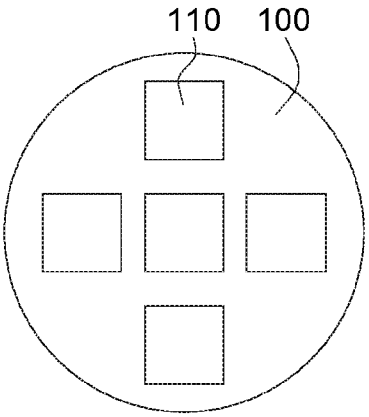

The multi-function lighting system of the present disclosure includes at least one lighting module and an electric controlling system. The at least one lighting module includes a plurality of lighting sub-modules. Each lighting sub-module includes a plurality of LEDs. The electric controlling system includes a lighting module control unit for controlling the light intensity, the color temperature and the beam angle of the lighting module, the lighting sub-modules and the LEDs. The electric controlling system further includes an environment sensing unit for sensing the light environment (for example brightness) in the space to modulate the beam angle or luminous intensity of part or all of the lighting module, part or all of lighting sub-module or part or all of LEDs (include multi-chip package LEDs). As such, the UGR can be ranged from 10 to 15. The lighting module, lighting sub-module, LEDs/Multi-chip package LEDs or the substrate can be planar or non-planar (for example orbicular, elliptic, irregular), to adjust the beam angle, the uniformity of the light and improve the glare. For example, as shown FIGS. 19A to 19D, FIGS. 19A and 19B show a side view and a top view of one embodiment, and FIGS. 19C and 19D show a side view and a top view of another embodiment. Furthermore, a quick connecting structure can be used among the lighting modules, the lighting sub-modules and LEDs (include multi-chip package LEDs).

Figure 20:
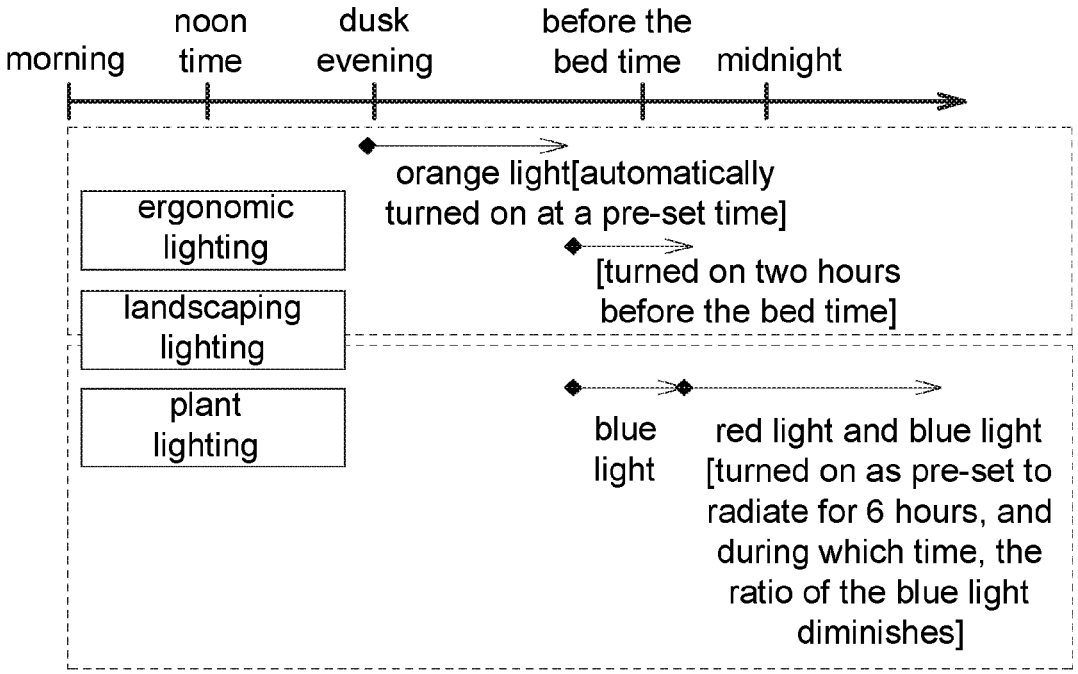
FIGS. 20, 21, 22 and 23 show various embodiments of the application of a lighting system.

In the application of the disclosure, the light is modulated according to the states and needs of the light environment under different scenarios. FIG. 20 shows a modulation diagram when the light system of the disclosure is implemented in a lounge. In the part of the ergonomic lighting, the light is turned off during the daytime when nobody is at home during the daytime; the orange light is automatically turned on around the dusk evening when people are off from their work and need to have a break; and the plant lighting is turned on two hours before the bed time. In the part of the plant lighting, the blue light is turned on first, and then the red light and the blue light are turned on as pre-set to radiate for 6 hours, and during which time, the ratio of the blue light diminishes. In the part of landscaping lighting, the light is generated in a customization way to fit the user's needs.

Figure 21:
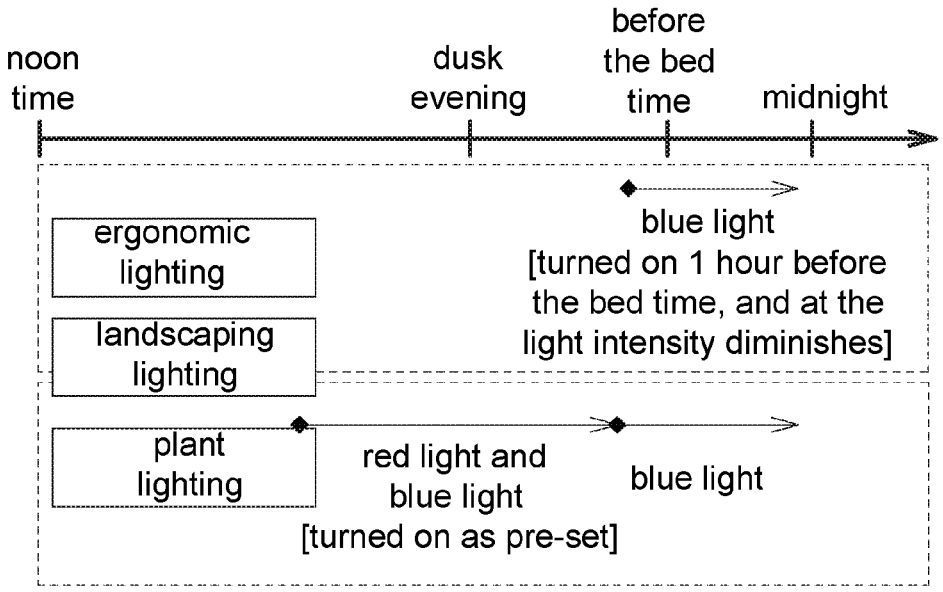

FIG. 21 shows a modulation diagram when the light system of the disclosure is implemented in a bedroom. When the plant lighting is inadequate, the red light and the blue light are turned on around the dusk evening, and the blue light is turned on 1 hour before the bed time, and at the light intensity diminishes to relax people's moods. In the part of landscaping lighting, the light is generated in a customization way to fit the user's needs.

Figure 22:
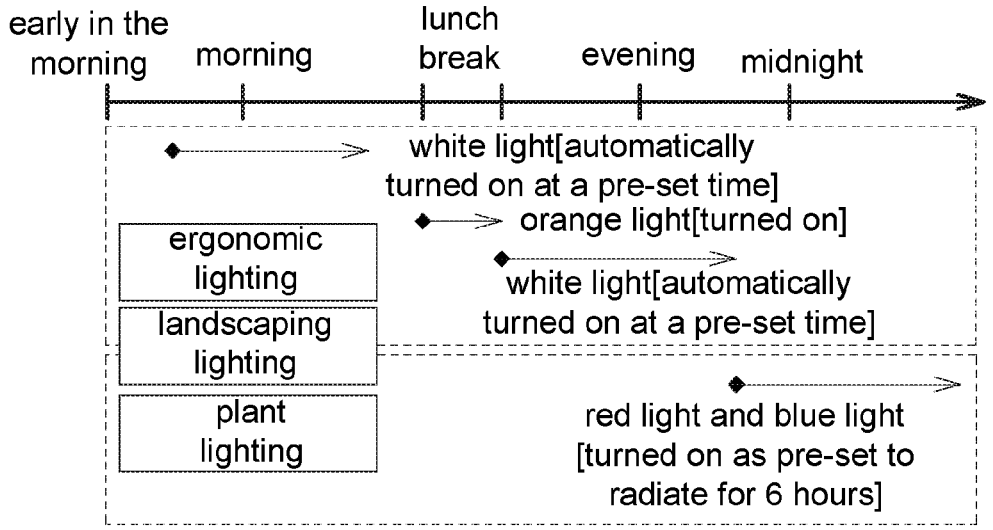

FIG. 22 shows a modulation diagram when the light system of the disclosure is implemented in an office. The white light is automatically turned on at a pre-set time in the morning. The orange light is turned on to relax people's mood during the lunch break. The white light is automatically in the afternoon and during the overtime in the evening. The plant lighting is turned on in the midnight when nobody is in the office. The red light and the blue light are turned on as pre-set to radiate for 6 hours in the night time. In the part of landscaping lighting, the light is generated in a customization way to fit the user's needs.

Figure 23:
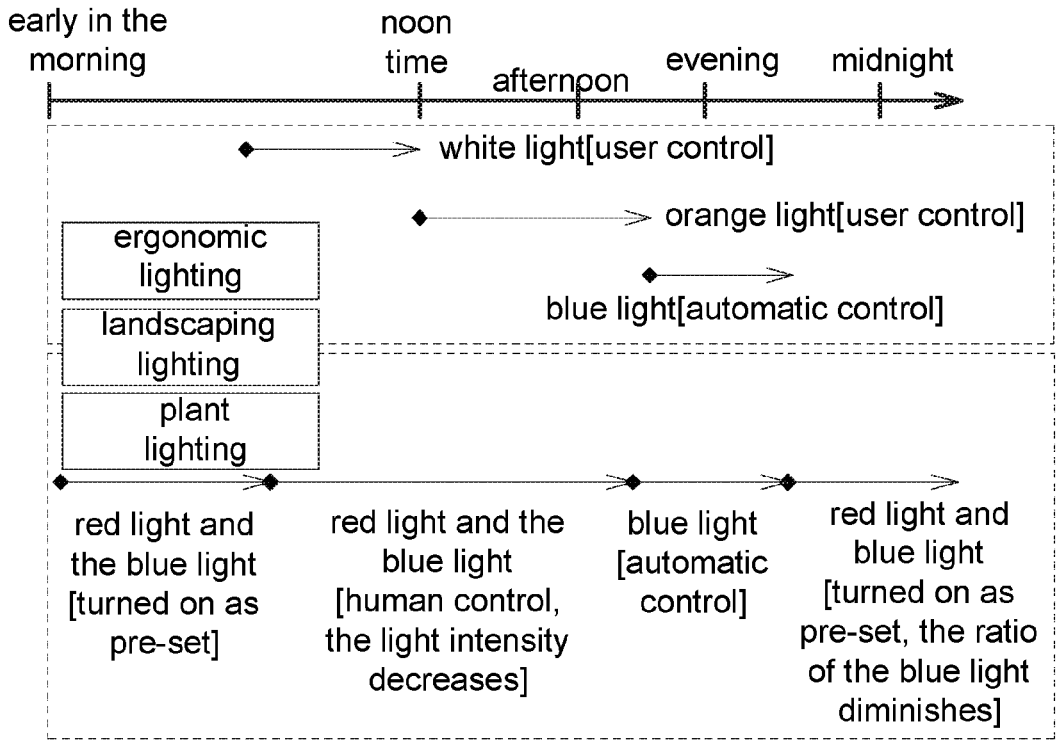

FIG. 23 shows a modulation diagram when the light system of the disclosure is implemented in a garden. The white light is turned on for reading in the morning time. The orange light is turned on for people to relax in the afternoon. The blue light is automatically turned on to give people a feeling of serenity in the evening. In the lighting part of plant, the red light and the blue light are turned automatically in the morning; the light intensity of the red light and the blue light can be dimmed by the user in the noon time and the afternoon; the blue light is automatically in the evening; the red light and the blue light are automatically in the night time, and the ratio of the blue light diminishes. In the part of landscaping lighting, the light is generated in a customization way to fit the user's needs.

A design of multiplex configuration of a lighting module and a design of optical time domain modulation of an electric controlling system are applied to the lighting system which senses environmental conditions to change the color, the light intensity and the color-temperature of the light automatically or artificially to influence people's feelings and moods. At the same time, the environmental sensing device further feedbacks the information of humidity or temperature so that the parameter of optimum light environment can be set accordingly. Based on a diversity of specifications of the lighting lamps, landscaping modeling, and schemes of light environment, the lighting system of the disclosure adopts different designs with high flexibility for the LEDs, the lighting sub-modules and the lighting modules, and the products are manufactured in a customization way to provide a diversified combination and configuration. Through the varied dispositions and arrangements of the light quality, the light intensity, the color temperature of the light generated by the light source, varied combinations of designs of light patterns can be provided. Furthermore, the electric controlling system can also adjust the architecture of the elements to meet different needs, such that the lighting system can be manufactured in a customization way to meet varied requirements in the landscaping and optical designs, not only having the advantages of reducing the cost and speeding mass production, but also providing multi-functions including landscaping lighting, ergonomic lighting, plant lighting and air purifying.

While the disclosure has been described by way of example and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-function lighting system, comprising:

at least a lighting module, wherein each lighting module includes a plurality of lighting sub-modules with different spectrums or different color temperatures, each of the lighting sub-modules includes a plurality of light emitting diodes; and an electric controlling system, comprising:

a lighting module control unit, which modulates a light quality, a light intensity and a color temperature of a light generated by the lighting module and modulates a beam angle of a light generated by each of the lighting sub-modules or part of the light emitting diodes, so that the at least a lighting module generates at least two light source states corresponding to at least two scenarios.

2. The multi-function lighting system according to claim 1, wherein the electric controlling system further comprises an environment sensing unit which senses an environmental condition or receives an electromagnetic signal or a sound signal.

3. The multi-function lighting system according to claim 1, wherein the lighting module outputs an optical signal.

4. The multi-function lighting system according to claim 1, wherein the electric controlling system further comprises a module sensing unit for sensing the temperature and an electric performance of the lighting module.

5. The multi-function lighting system according to claim 1, the lighting module further comprises a module sensing unit for sensing the temperature and an electric performance of the lighting module.

6. The multi-function lighting system according to claim 1, wherein the number of the at least one lighting module is more than one.

7. The multi-function lighting system according to claim 1, wherein the electric controlling system further comprises a memory database unit for storing a relationship between a plurality of light environmental parameters and a plurality of plants.

8. The multi-function lighting system according to claim 1, wherein the lighting module control unit control the lighting module to show a plurality of light frames, and the light frames are decoded to be a light message.

9. The multi-function lighting system according to claim 1, wherein the lighting module includes a wireless charging unit.

10. The multi-function lighting system according to claim 1, wherein each of the at least a lighting module comprises a plurality of light emitting diodes (LEDs) with different spectrums or color temperatures, the lighting module control unit individually modulates the beam angle, the light quality, the light intensity and the color temperature of the light generated by each lighting sub-module or each LED, or modulates the beam angle, the light quality, the light intensity and the color temperature of the light generated by part or all of the lighting sub-modules or part or all of the LEDs.

11. The multi-function lighting system according to claim 10, wherein the electric controlling system further comprises:

an environment sensing unit, which senses an environmental condition for controlling the lighting module accordingly.

12. The multi-function lighting system according to claim 10, wherein the electric controlling system further comprises:

an operation controlling unit, which modulates the beam angle, the light quality, the light intensity and the color temperature of the light generated by the lighting module according to a setting of light environment.

13. The multi-function lighting system according to claim 10, wherein the electric controlling system further comprises:

a memory database unit in which a light environment parameter is stored.

14. The multi-function lighting system according to claim 10, wherein the lighting module comprises:

a plurality of lighting sub-modules; and a substrate on which the lighting sub-modules are disposed.

15. The multi-function lighting system according to claim 10, wherein the lighting module control unit individually modulates the lighting sub-modules or the LEDs, or concurrently modulates the lighting sub-modules or the LEDs, so that the lighting module generates a monochromic spectrum, a polychromic spectrum or a mixed light spectrum.

16. The multi-function lighting system according to claim 15, wherein the electric controlling system further comprises:

an environment sensing unit, which senses an environmental condition for controlling the lighting module accordingly.

17. The multi-function lighting system according to claim 15, wherein the electric controlling system further comprises:

an operation controlling unit, which modulates the beam angle, the light quality, the light intensity and the color temperature of the light generated by the lighting module according to a setting of light environment.

18. The multi-function lighting system according to claim 15, wherein the electric controlling system further comprises:

a memory database unit in which a light environment parameter is stored.

19. The multi-function lighting system according to claim 15, wherein the lighting module comprises:

a plurality of lighting sub-modules; and a substrate on which the lighting sub-modules are disposed.

20. The multi-function lighting system according to claim 10, wherein each of the at least a lighting sub-module generates two lights with more than two wavelengths or color temperatures.

21. The multi-function lighting system according to claim 20, wherein the electric controlling system further comprises:

an environment sensing unit, which senses an environmental condition for controlling the lighting module accordingly.

22. The multi-function lighting system according to claim 20, wherein the electric controlling system further comprises:

an operation controlling unit, which modulates the beam angle, the light quality, the light intensity and the color temperature of the light generated by the lighting module according to a setting of light environment.

23. The multi-function lighting system according to claim 20, wherein the electric controlling system further comprises:

a memory database unit in which a light environment parameter is stored.

24. The multi-function lighting system according to claim 20, wherein the lighting module comprises:

a plurality of lighting sub-modules; and a substrate on which the lighting sub-modules are disposed.

25. A multi-function lighting system, comprising:

at least a lighting module, wherein each lighting module includes a plurality of lighting sub-modules, each of the lighting sub-modules includes a plurality of light emitting diodes; and an electric controlling system, comprising:

a lighting module control unit, which modulates a beam angle, a light quality, a light intensity and a color temperature of a light generated by each of the lighting sub-modules or part of the lighting emitting diodes to be different from others, so that the at least a lighting module generates at least two light source states corresponding to at least two scenarios.

26. The multi-function lighting system according to claim 25, wherein the electric controlling system further comprises an environment sensing unit which senses an environmental condition and receives an electromagnetic signal.

27. The multi-function lighting system according to claim 25, wherein the lighting module outputs an optical signal.

28. The multi-function lighting system according to claim 25, wherein the electric controlling system further comprises a module sensing unit for sensing the temperature and an electric performance of the lighting module.

29. The multi-function lighting system according to claim 25, the lighting module further comprises a module sensing unit for sensing the temperature and an electric performance of the lighting module.

30. The multi-function lighting system according to claim 25, wherein the number of the at least one lighting module is more than one.

31. The multi-function lighting system according to claim 25, wherein the electric controlling system further comprises a memory database unit for storing a relationship between a plurality of light environmental parameters and a plurality of plants.

32. The multi-function lighting system according to claim 25, wherein the lighting module control unit control the lighting module to show a plurality of light frames, and the light frames are decoded to be a light message.

33. The multi-function lighting system according to claim 25, wherein the lighting module includes a wireless charging unit.

34. The multi-function lighting system according to claim 25, wherein each of the at least a lighting module comprises a plurality of light emitting diodes (LEDs) with different spectrums or color temperatures, the lighting module control unit individually modulates the beam angle, the light quality, the light intensity and the color temperature of the light generated by each lighting sub-module or each LED, or modulates the beam angle, the light quality, the light intensity and the color temperature of the light generated by part or all of the lighting sub-modules or part or all of the LEDs.

35. The multi-function lighting system according to claim 34, wherein the electric controlling system further comprises:

an environment sensing unit, which senses an environmental condition for controlling the lighting module accordingly.

36. The multi-function lighting system according to claim 34, wherein the electric controlling system further comprises:

an operation controlling unit, which modulates the beam angle, the light quality, the light intensity and the color temperature of the light generated by the lighting module according to a setting of light environment parameters.

37. The multi-function lighting system according to claim 34, wherein the electric controlling system further comprises:

a memory database unit in which a light environment parameter is stored.

38. The multi-function lighting system according to claim 34, wherein the lighting module control unit individually modulates the lighting sub-modules or the LEDs, or concurrently modulates the lighting sub-modules or the LEDs, so that the lighting module generates a monochromic spectrum, a polychromic spectrum or a mixed light spectrum.

* * * * *